US011098890B2

(12) United States Patent
Usci et al.

(10) Patent No.: US 11,098,890 B2
(45) Date of Patent: Aug. 24, 2021

(54) THIN PREMIXED ATMOSPHERIC DOMESTIC BURNER

(71) Applicant: TRE P ENGINEERING S.R.L., Chiaravalle (IT)

(72) Inventors: Rosalino Usci, Jesi (IT); Michele Marcantoni, Polverigi (IT)

(73) Assignee: TRE P ENGINEERING S.R.L., Chiaravalle (IT)

( * ) Notice: Subject to any disclaimer, the term of this patent is extended or adjusted under 35 U.S.C. 154(b) by 781 days.

(21) Appl. No.: 15/506,532

(22) PCT Filed: Aug. 21, 2015

(86) PCT No.: PCT/IB2015/001466
§ 371 (c)(1),
(2) Date: Feb. 24, 2017

(87) PCT Pub. No.: WO2016/030743
PCT Pub. Date: Mar. 3, 2016

(65) Prior Publication Data

US 2017/0254533 A1 Sep. 7, 2017

(30) Foreign Application Priority Data

Aug. 29, 2014 (IT) ..... AN2014A000130

(51) Int. Cl.
*F23D 14/06* (2006.01)

(52) U.S. Cl.
CPC .... *F23D 14/06* (2013.01); *F23D 2900/14063* (2013.01)

(58) Field of Classification Search
CPC . F23D 14/06; F23D 2900/14063; F23D 14/04
(Continued)

(56) References Cited

U.S. PATENT DOCUMENTS 4,078,877 A * 3/1978 Friedl ..... B60H 1/2203 431/1
4,083,355 A 4/1978 Schwank
(Continued)

FOREIGN PATENT DOCUMENTS

CA 2385028 A1 * 2/2002 ..... F23D 14/08
EP 2189719 A2 * 5/2010 ..... F23D 14/06
(Continued)

*Primary Examiner* — Steven B McAllister
*Assistant Examiner* — Aaron H Heyamoto
(74) *Attorney, Agent, or Firm* — Locke Lord LLP; Nicholas J. DiCeglie, Jr.; Georgi Korobanov

(57) ABSTRACT

The object of the present invention is an atmospheric gas burner (300) for cooking tops (400), in particular household cooking tops (400), where the air-gas mixture is obtained by the effect of the gas supply pressure using the principle of the tube ejector (10; 310) of Venturi that has a sufficient quantity Z≥1 of ejectors (310) to supply, globally, the maximum power ($W_b$) provided for the same burner (300). Each of said ejectors (310) develops on a horizontal plane, has the axis of its diffuser (315) which in the first stretch (322) is substantially rectilinear and tangential to a circle with centre on the central axis (324) of said burner (300) while in the second stretch (323) gradually bends substantially as a spiral towards the same central axis (324), leads, downstream of said diffuser (315), to a converging channel (327) which gradually bends vertically upwards and which, in turn, leads to one or more diffusion chambers (328) to which one or more flame spreading caps (318) act as a cover.

26 Claims, 12 Drawing Sheets

(58) Field of Classification Search
USPC ..... 126/39 E
See application file for complete search history.

(56) References Cited

U.S. PATENT DOCUMENTS

| | | | | |
|---|---|---|---|---|
| 8,683,991 | B2 * | 4/2014 | Gasparini | F23D 14/08 126/39 E |
| 2005/0277080 | A1 * | 12/2005 | Wu | F23D 14/065 431/354 |
| 2011/0120445 | A1 * | 5/2011 | Armanni | F23D 14/06 126/39 E |
| 2014/0331989 | A1 * | 11/2014 | Lin | F24C 3/085 126/39 E |

FOREIGN PATENT DOCUMENTS

| | | | | |
|---|---|---|---|---|
| FR | 2999276 | A1 | | 6/2014 |
| JP | H1163431 | A | | 3/1999 |
| JP | 2006138591 | | * | 6/2006 |
| JP | 2006138591 | A | | 6/2006 |
| TW | 20083953 | A | * | 10/2008 |
| TW | 200839153 | A | | 10/2008 |

* cited by examiner

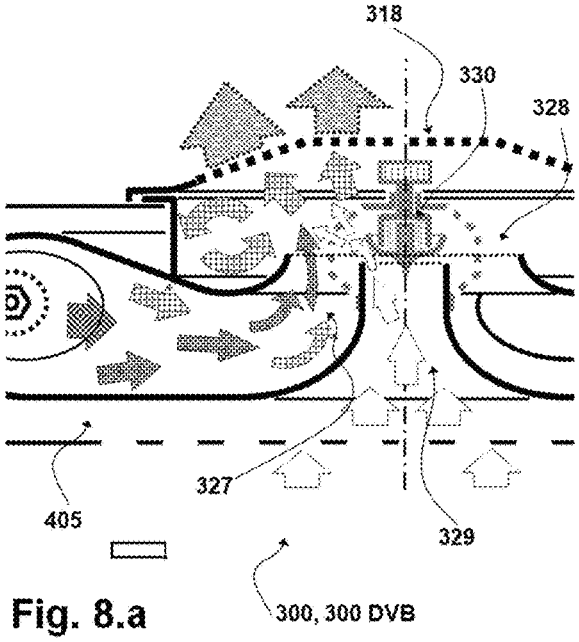
Fig. 8.a
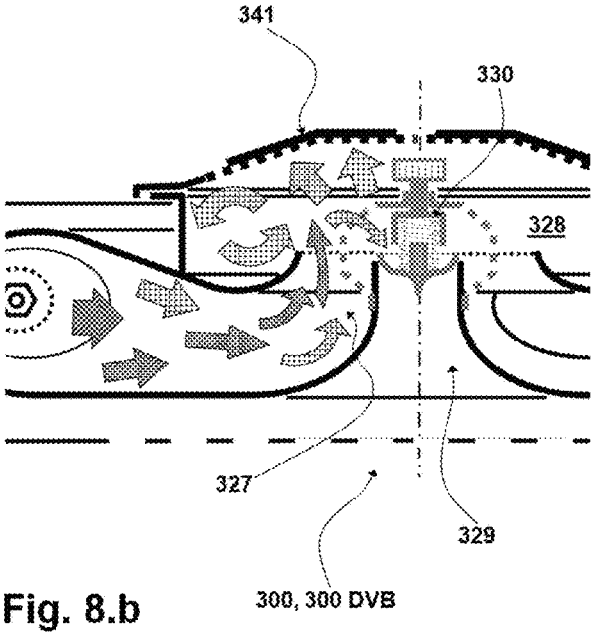
Fig. 8.b
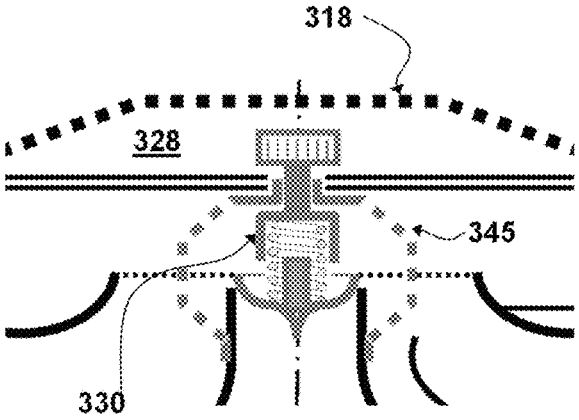
Fig. 9.a
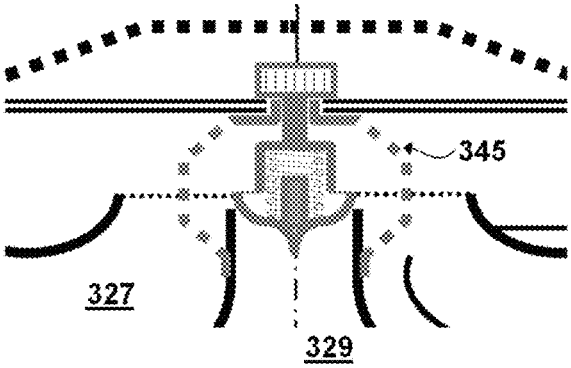
Fig. 9.b

THIN PREMIXED ATMOSPHERIC DOMESTIC BURNER

CROSS REFERENCE TO RELATED APPLICATIONS

This application is a 35 U.S.C. § 371 National Phase Application of International PCT Patent Application No. PCT/IB2015/001466, filed Aug. 21, 2015 which application claims the benefit of priority to Italian Patent Application No. AN2014A000130, filed Aug. 29, 2014, the contents of each of which are hereby incorporated herein by reference in their entirety.

The present invention relates to an innovative type of atmospheric gas burner for cooking tops, in particular household cooking tops, capable of producing an air-gas mixing with a stoichiometric titre or with a slight excess of air; a burner thus capable of producing fully premixed flames and possibly with excess of air.

By atmospheric burner it is meant a burner where the air-gas mixture is obtained by the effect of the gas supply pressure using the principle of the tube ejector of Venturi and without the aid of fans.

The ejectors (v. FIG. 2), are extremely simple, economical and reliable devices and it is for this reason that they are used for the fuel air-gas mixing in the burners of cooking tops. Substantially all of the household gas cooking tops currently on the market use atmospheric burners.

In the tube ejector of Venturi (hereinafter simply "ejector"), the pressure energy of a motor fluid available at a nozzle located at the inlet of a Venturi tube with nozzle flow rate Q, and nozzle pressure $P_m$, is transformed into kinetic energy; the high-velocity jet coming out from the nozzle induces and drags an induced fluid flow at a lower pressure $P_i$ which flows in at a flow rate regime $Q_i$; both flows are conveyed within a pipe having section $A_{thr}$ (which is the Venturi groove) where they mix and recover part of the pressure; then the mixing continues in a diverging section (which is the Venturi diffuser) where additional kinetic energy is recovered in static pressure.

In this case, the pressure of the secondary $P_i$ is the atmospheric pressure $p_a$, the motor fluid with flow rate $Q_m$ is a fuel gas with flow rate $Q_{gas}$ and pressure $p_{gas}$ and the induced fluid with flow rate $Q_i$ is the combustion air with flow rate $Q_a$ and pressure $p_a$; because of the very modest pressure variations that the gases are subject to while crossing the Venturi, they can be considered in incompressible regime.

The ideal length of the Venturi groove is comprised between 7 and 10 times its diameter D; the diffuser has a weak opening to recover pressure avoiding the stall (typically 2-3° half-open).

At the outlet of the diffuser, fuel gas and combustion air are, substantially fully mixed, with a flow rate of the mixture $Q_{mix}=Q_{gas}+Q_a$ and a pressure $p_{mix}$.

Said stoichiometric mixture is an air-gas mixture where the air and gas masses are in a mixture ratio (mixture titre) equal to the exact stoichiometric ratio STC for a complete combustion of the gas without residual oxygen. A mixture rich in gas, that is to say with a mixture ratio <STC, i.e. with lack of air, is herein referred to as "rich" mixture. A mixture poor in gas, that is to say with a mixture ratio >STC, i.e. with excess of air, is herein referred to as "lean" mixture. For a complete combustion, in practice, a mixture with a slight excess of air in required compared to the STC ratio theoretically sufficient. Hereinafter, however, by "stoichiometric" titre mixture or "STC mixture" it is meant a mixture with the that minimum slight excess of air necessary to ensure the complete combustion.

Ejector efficiency $\eta_{ej}$ is herein defined as the ratio between the kinetic energy in the time unit of the mixture at the outlet of the diffuser, which is $E_{mix}=(P_{mix}-P_i)\times Q_{mix}$, and the kinetic energy at the nozzle, which is $Egas=(p_{gas}-P_i)\times Q_{gas}$.

That is, $\eta_{ej}=E_{mix}/E_{gas}=[(P_{mix}-P_i)\times Q_{mix}]/[p_{gas}-P_i)\times Q_{gas}]$.

The geometry of Venturi is a determining element for the efficiency $\eta_{ej}$ of the ejector.

The greater is the efficiency $\eta_{ej}$ of the ejector the greater is the combustion air flow rate $Q_a$ that may be induced and if this was sufficient to obtain mixtures with a slight excess of air, the ejector burner would be independent from any supply of additional air.

This is possible in principle, if there are no dimensions limits, by accurately sizing, depending on the thermal power required, the diameter D and the length L20 of the Venturi groove and the length L30 and the angle of divergence $B_2$ of the diffuser.

However, for burners for cooking tops, in particular household cooking tops, which provide for nominal powers of the various gas cookers (typically in number 4, 5 or 6) from 600÷800 W to 3 kW to arrive at 5 kW in the case of "special burners", the geometrical and dimensional constraints of the cooking top and the operating parameters of the burners are absolutely incompatible with the ideal construction criteria for the ejectors with consequent dramatic drop of the efficiency to very few percentage points because the induced combustion air, called "primary air", is not sufficient to obtain mixtures with STC titre that allow the complete combustion. The resulting drawbacks shall now be highlighted.

The most widespread, universally accepted and most traditional technical solution for making a gas burner of a cooking top 400, is that with the "vertical Venturi" (see FIG. 3).

In this configuration, which can be considered the standard one, and henceforth designated as STD, the ejector is particularly inefficient mainly because of the leaks in the diffuser 115, which is radial, and the reduced longitudinal extension of the Venturi that is well far from the ideal shape and substantially coincides with the groove 114. $\eta_{ej}$ values in the range of 1% are frequent.

In substance, inside the ejector that draws primary air AIR11 a mixture too rich in fuel is obtained but still within the flammability range of the gas. The rich mixture exiting vertically from the groove 114, is conveyed through the radial diffuser 115 to the "slots" 117. From there the mixture exits with a titre that already allows the partial combustion and feeds the flames FLAME1; these recall by floating (that is, by natural circulation due to the difference in density) additional AIR21, called "secondary" essential for the completion of the chemical reaction of combustion.

The need for supply of secondary air in fact limits the power density of the flame which can only be composed of a discontinuous crown of flames or there would be lack of oxygen to the inner surface of the same crown. By excessively thickening the slots 117, the flames would not develop enough surface for interacting with the secondary air, resulting in excessive production of carbon monoxide (CO), or better of an unacceptably high value of the ratio $[CO]/[CO_2]$ in the fumes.

The slots 117 are essentially few tens of radial channels made with radial incisions on the body of the "flame spreader" 116 (or holes) and closed at the top by the "cap" 118 (an actual cover); thus the base of the flames has a centrifugal radial development as, moving away from the perimeter of the burner, the various "bulbs" of the crown of flames FLAME1 deviate upward in the direction of the bottom of the pot 404 due to floatation.

With the same nominal power, this type of STD architecture involves at least the dimensional drawbacks that is desirable to eliminate or at least mitigate.

The distance H01 between the base of the flames FLAME1 and the bottom of the pot 404 has a minimum limit due to the need of causing secondary air to flow smoothly inside the crown of flames.

Being able to reduce this parameter means increasing the efficiency $\eta_b$ of the burner, intended as the ratio between the heat effectively transferred to the pot and the heat produced by the burner.

Also the distance H11 between the base of the flames FLAME1 and the aesthetic surface 401 of the cooking top (hereinafter "covering top 401"), has a minimum limit due to the need to facilitate the access of the primary air AIR11 to the ejector.

As a consequence it is not possible to reduce the distance H31=H01+H11 between the pot and the covering top as desired; the pan stand grids (not shown in the enclosed drawings) are rather distant from the underlying covering top 401 with a strong limitation of freedom of product design.

Although there are STD burners capable of drawing primary air AIR11 below the covering top 401 (with suitable construction and installation devices of the same cooking top) in any case, the height H11 can not fall below certain limits due to the excessive heating of the same covering top 401, caused by the presence of radial flames.

It should be noted that, if such aesthetic limitation is little felt by the user, it is only because he considers it an inherent and inevitable functional need.

It is high the vertical space H21 of the mixing chamber 113 (referred to as "cup" 113), needed to seat the nozzle 111 (which must be able to be screwed on even after the installation of the cooking top 400) and to ensure optimal values of the distance L01 between nozzle 111 and Venturi groove 114 and a sufficient length L21 of the Venturi groove 114 where the mixing substantially completes in the STD configuration.

They are high values the minimum height H41 of compartment 405 underlying the covering top 401, greater than the H21 because the technical overall dimensions of the fuel gas supply pipe must be added to the nozzle 111.

In conclusion, with the STD configuration the vertical spaces are considerable and not only due to the component elements of the burner but also to the inevitable empty spaces that must be left around.

As for the modulation ratio Y obtainable from a STD burner, intended as the ratio between the maximum and minimum power that can be delivered with regular combustion, it depends on many factors, but first of all on the admissible range of speed of the mixture exiting from the slots 117. In fact, this must be comprised between a minimum speed $V_{min}$ below which there is backfire and a maximum speed $V_{max}$ above which there is the lift-off thereof.

According to rules well known to the men skilled in the art, $V_{min}$ and $V_{max}$ depend on the flame front speed $V_f$ which in turn depends, among other things, also on the titre of the mixture which, in turn, as seen, is affected by the geometry of the burner. In conclusion, since the flame stability $V_f$ is indirectly determined by the gas flow rate $Q_{gas}$ and the configuration of the burner, the modulation ratio Y achievable is strongly influenced by such factors Typically, for the STD configuration Y is comprised between 3.5 and 4.5.

For higher modulation ratios Y, "special" burners are used provided with more than one ejector that separately supplies more than one crown of concentric flames; these burners, which have special geometrical features in order to cause secondary air to flow also to the innermost crowns of flame, are in fact multiple burners although often provided with a single special regulation valve that can turn on and modulate them in sequence.

Burners with horizontal or "linear" Venturi configuration, herein referred to as "LIN" (see FIG. 4) have been available on the market since a few years ago.

This configuration carries a Venturi with a completely linear development (Venturi groove 214 and diffuser 215 in axis) arranged horizontally parallel to the covering top (it should be noted that in the STD burner the diffuser 115 is instead radial). The linear diffuser 215 leads to a further mixing chamber 213 that occupies all the internal volume of the burner within which the mixing of primary air AIR12 with the fuel gas continues and completes.

This solution allows to obtain mixtures still rich compared to the stoichiometric titre, that is, with lack of air, but significantly leaner than those obtainable with the STD solution. Accordingly, also in this case the supply of secondary air AIR22 is necessary, but in a smaller amount compared to the secondary air AIR21 of the STD case. With the same nominal power of the burner, and thus of the diameter of the injector nozzle, therefore, AIR22<AIR21.

The slots 217 are made with over a hundred of small holes formed directly on the cap 218 with direction inclined towards the vertical of the pot. Shorter flames FLAME2, almost vertical, with an increased power density and a crown that is circumferentially continuous and radially less extended than the STD case may be obtained. In substance, the thermal exchange towards the pot improves, the contact times of the fumes with the surface of the same pot increase and it is possible to reduce the distance H02 between the base of the flames FLAME2 and the bottom of the pot 404.

All of these considerations result in a higher efficiency $\eta_b$ of the burner.

As a confirmation of the absence of gas cookers with fully premix atmospheric burners, it is noted that the few examples of products with active supply of combustion air (referred to as "ventilated cooking tops") are in fact limited to means for supplying only the secondary air in order to complete what remains a partially premixed combustion. The market is made from gas burners with partially premixed burners; no one has claimed the fully premixed ones so far.

Comparing directly the STD solution with the LIN solution,

L22>>L21 $\eta_{ej}$ increasing significantly; accordingly:

AIR12>AIR11;

H02<H01 $\eta_b$ increasing;

H12<H11 because there is no more need for drawing air from under the "flame spreader" 116; accordingly, more appealing aesthetics may be proposed ("flush" burners of the cooking top 401);

H32<H31; accordingly, lower grids (not shown) may be proposed, also this to the benefit of aesthetic improvements;

H22<H21; accordingly there is no more need for feeding the fuel gas from the bottom towards the vertical nozzle, thus H42<<H41 being able to reduce the vertical space of the entire built in cooking top.

However, not even the LIN burners are free from drawbacks.

Despite such strong adaptations, the maximum value of the modulation ratio for the LINs remains limited to Y≈3. This is due to the concurrence of two factors, both related to the combustion dynamics: the fact that the titre of the mixture obtained in the Venturi is closer to the STC titre, involves a greater flame speed $V_f$ with greater risk of backfire; at the same time, simplifying, because the flames FLAME2 are shorter, for the fact that the combustion completes more quickly as it needs lower supply of secondary air, they are also more unstable and lift-off more easily than in the STD burner.

In a STD burner, changing the type of gas requires only changing the nozzle 111 as changing the cup 113 is either impossible for space reasons or is anyway useless because it would result in modest improvements of the efficiency $\eta_{ej}$ of the ejector. In a LIN burner, instead, in order to adapt it to all types of gas the replacement of the entire burner is necessary, because both the size of the Venturi and the morphology of the slots 217 on the cap 218 must be different for different classes of gas or the flame would be unstable.

The solutions with linear Venturi LIN currently on the market present, although in a slightly reduced form compared to the STD burners, all the limitations of a non-stoichiometric mixture (too rich) because inside the household cooking top, for the power required by each burner, there is not enough space for seating an ejector of optimised size to induce primary air AIR12 up to the stoichiometric titre. In any case, in addition to space limitations, the linear extension of the divergent diffuser 215 must in any case be truncated in order to be jointed to the mixing chamber 213, which in turn must be large enough to allow a complete mixing of AIR12 with the gas, otherwise there would be unevenness and instability of the flames FLAME2.

The main object of the present invention is to provide a new concept atmospheric burner of limited thickness suitable for use for cooking tops, household ones in particular, which eliminates at least in part the drawbacks listed above.

A further object of the present invention is to obtain, through said atmospheric burner, an air-gas mixture closer to the stoichiometric titre than what is allowed to LIN burners.

A further object of at least some variants of the present invention is to obtain, through said atmospheric burner, an air-gas mixture of a stoichiometric titre or leaner, which therefore does not require the supply of secondary air above the flame.

A further object, at least of some variants of the present invention is to obtain the previous results with said atmospheric burner of reduced plan dimensions with respect to a LIN burner of equal power.

A further object, at least of some variants of the present invention, is to obtain, modulation ratios Y higher than those possible today for cooking tops.

A further object, at least of some variants of the present invention, is to obtain better efficiencies $\eta_b$ of the burner than those possible with the STD and LIN burners known today.

A further object, at least of some variants of the present invention, is to reduce the distance necessary today between the base of the flames and the bottom of the overlying pot.

A further object, at least of some variants of the present invention, is to be able to make burners of different power by using also a few modular elements that are mutually modular.

A further object of at least some variants of the present invention, is to allow a better aesthetic appearance of the cooking top.

Further features and advantages of the present invention shall be better highlighted by the following description of an atmospheric burner for cooking tops in accordance with the main claims, articulated in possible variants in accordance with the dependent claims and illustrated, by way of a non-limiting example, with the aid of the annexed drawing tables, wherein:

Figure 5:
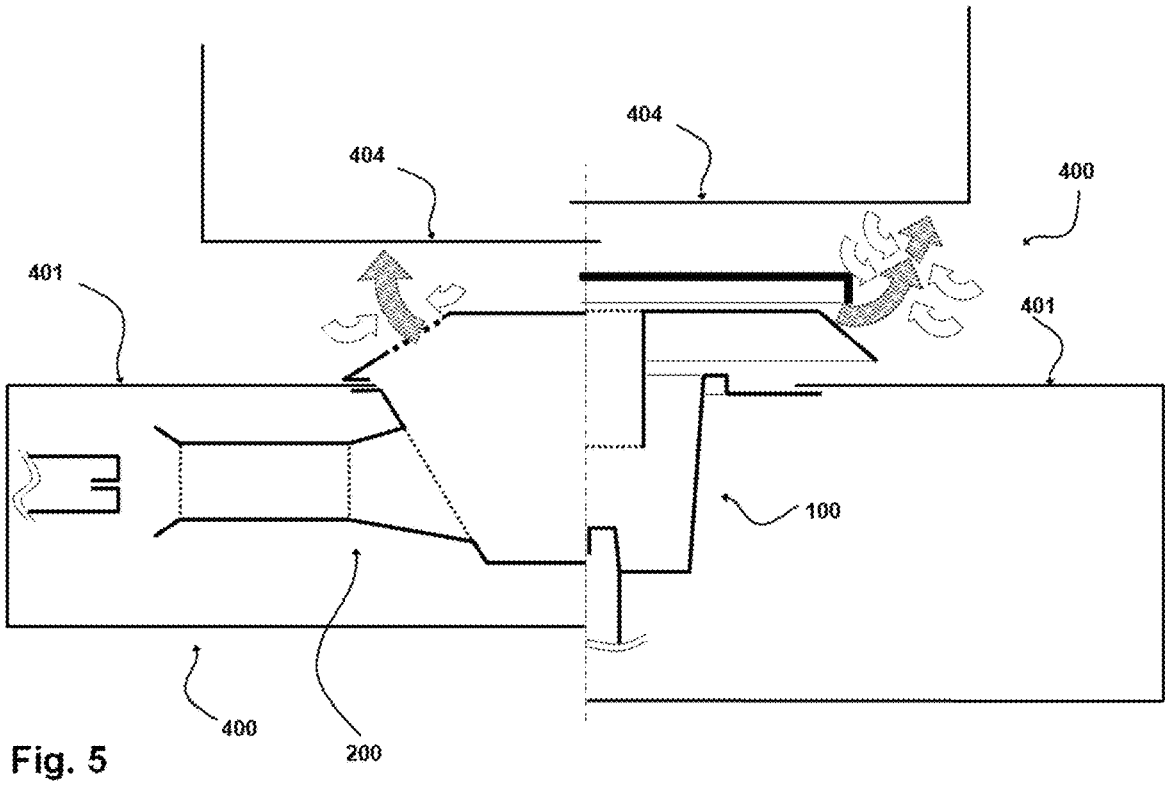
Figure 6:
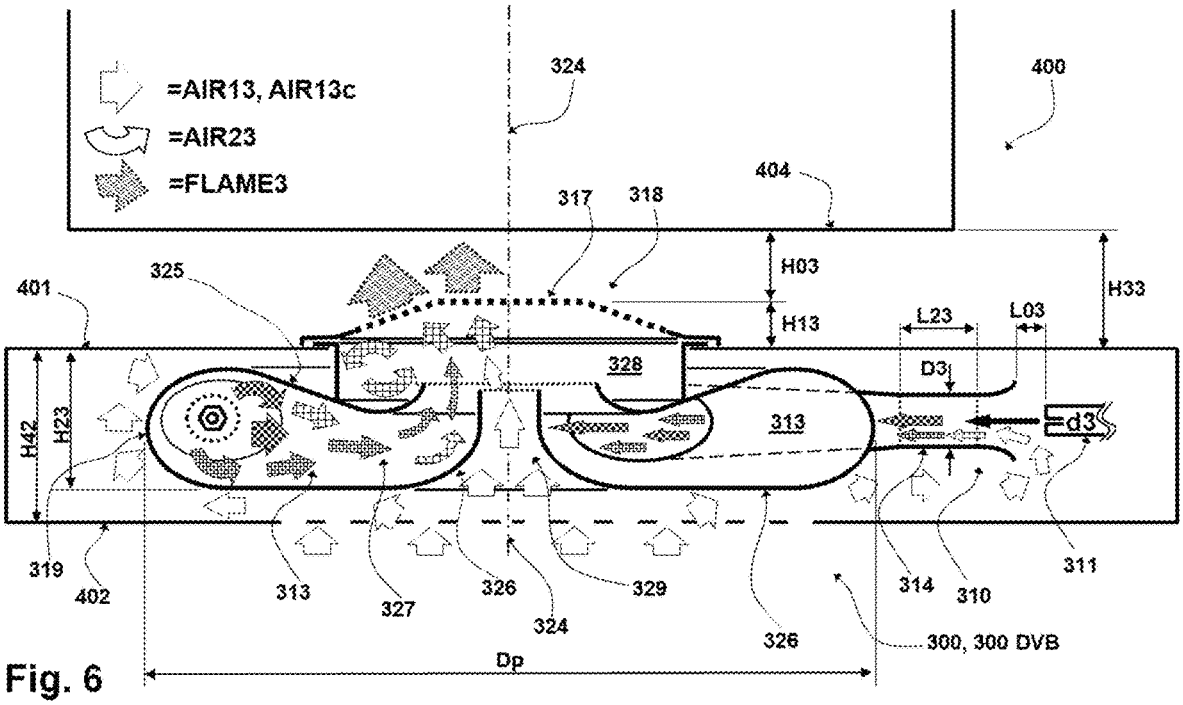
Figure 7:
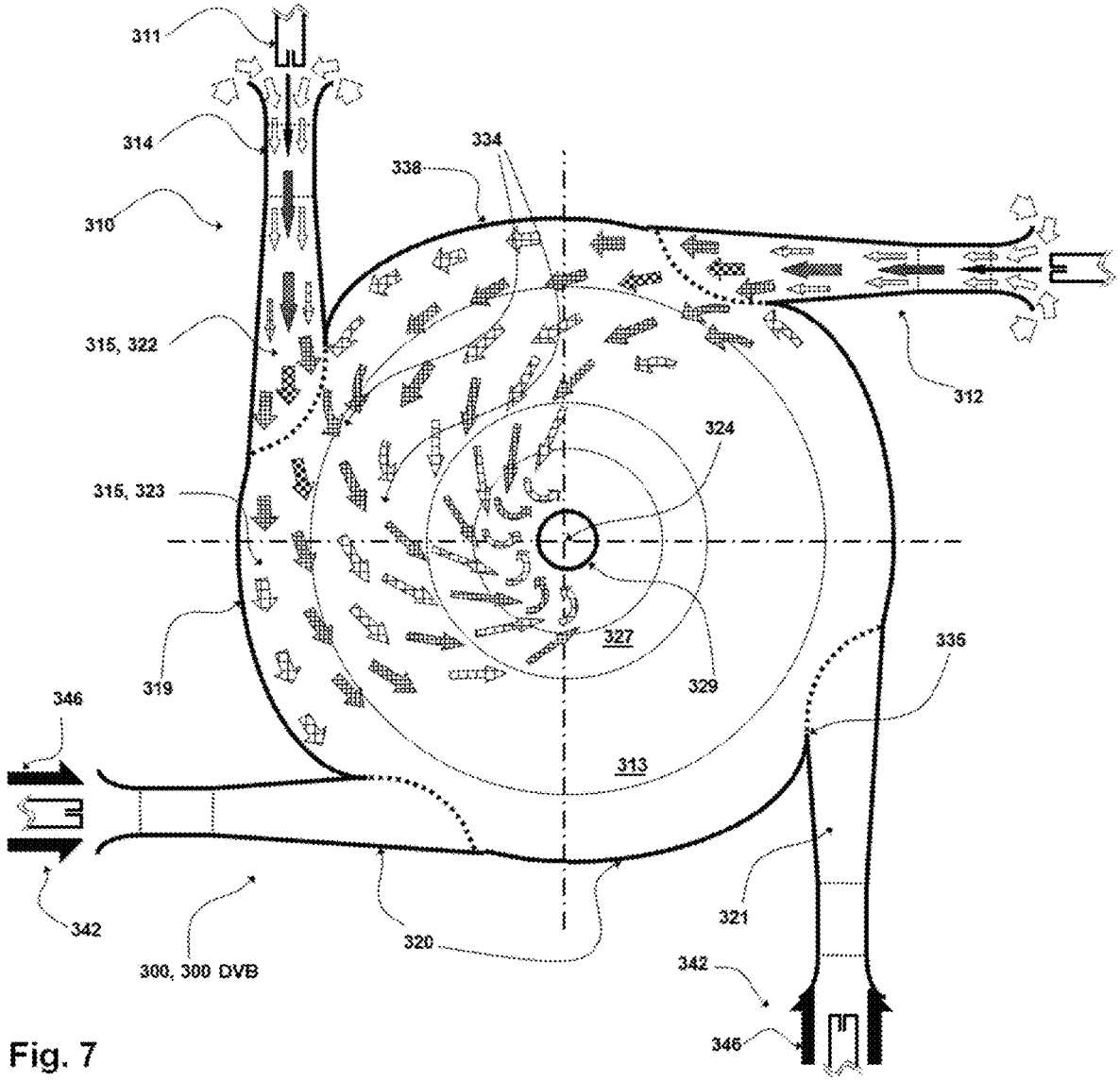

FIG. 5 compares, in vertical section, a burner of LIN type with one of STD type of equal power;

FIG. 6 shows, in vertical section, a burner according to the invention; in particular, according to a first basic version;

FIG. 7 shows, in horizontal section, the burner of FIG. 6;

FIGS. 8.*a* and 8.*b* show a detail of FIG. 6 but with an additional variant;

FIGS. 9.*a* and 9.*b* show a detail of FIGS. 8.*a* and 8.*b;*

Figure 10:
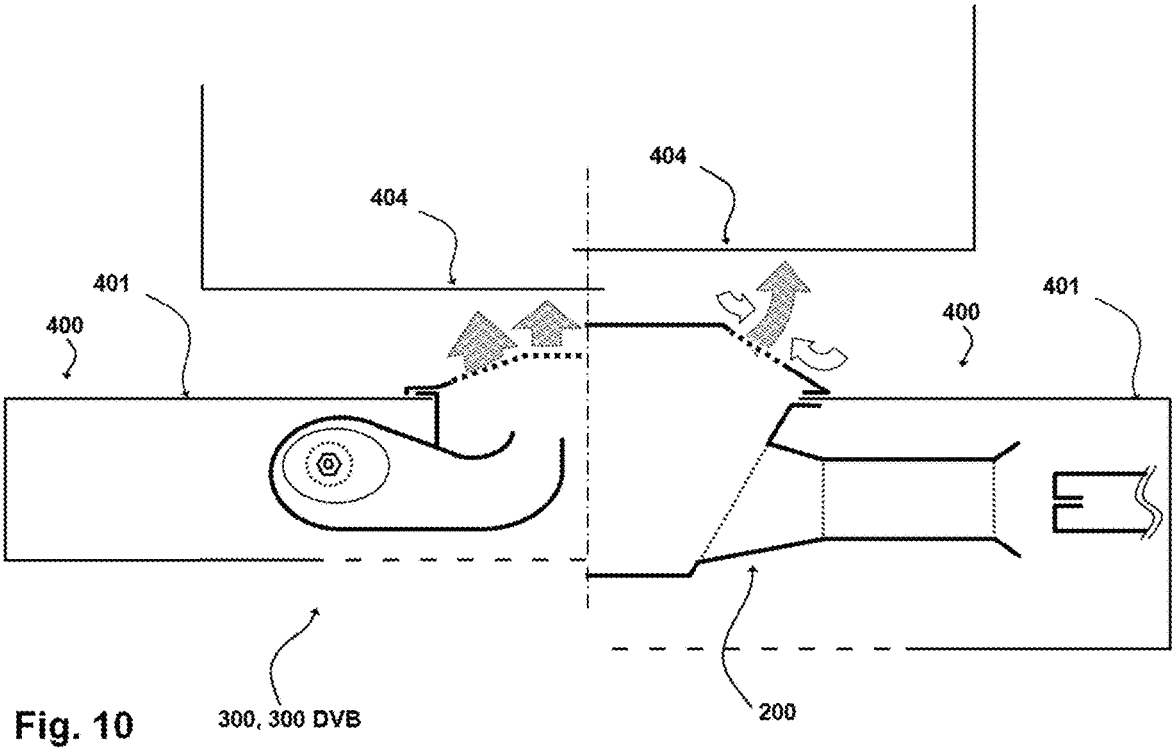
Figure 11:
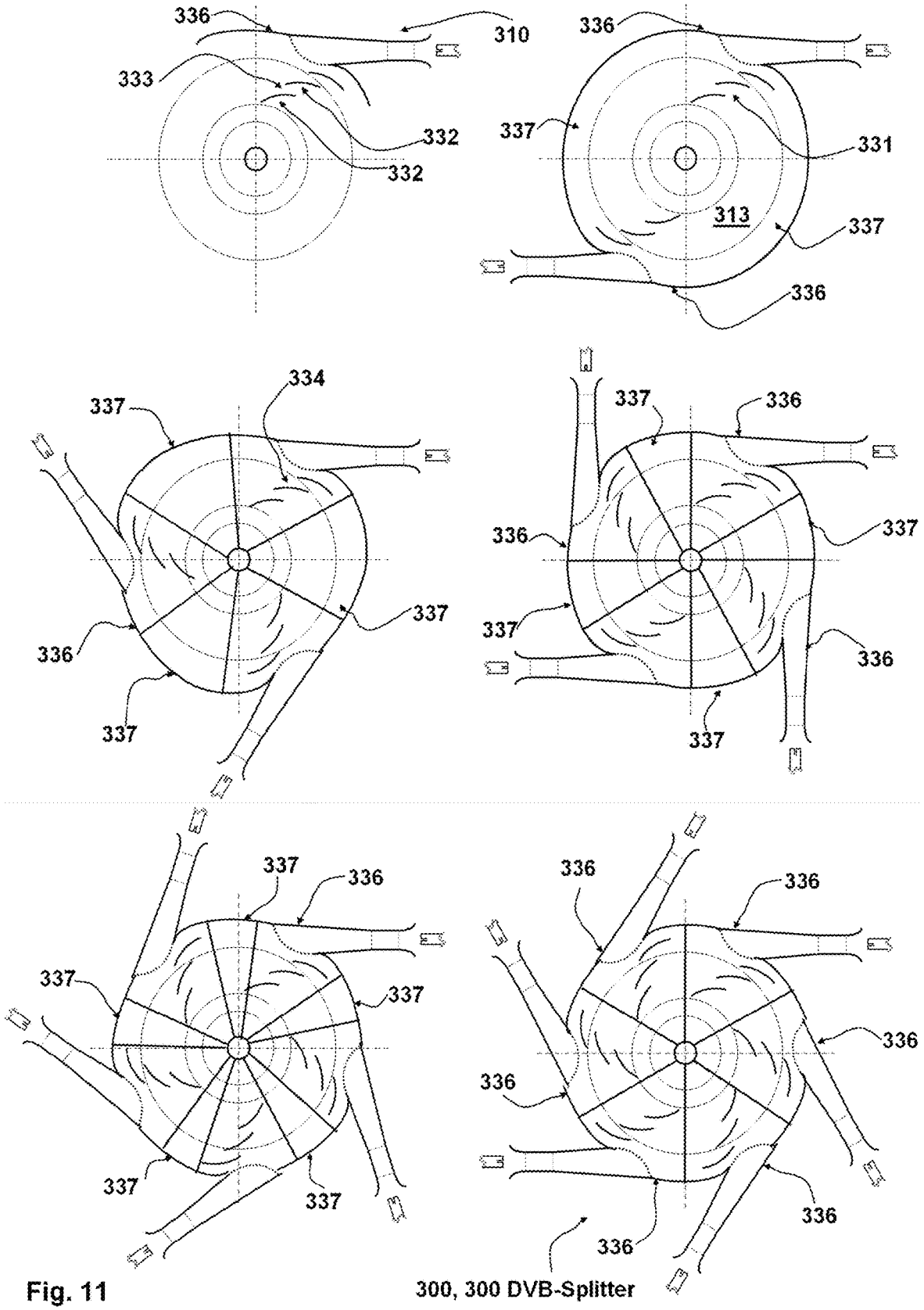

FIG. 10 compares, in vertical section, a burner according to the invention with one of LIN type of equal power;

FIG. 11 shows a modular element of the burner according to the invention and five possible combinations of the same.

Figure 12:
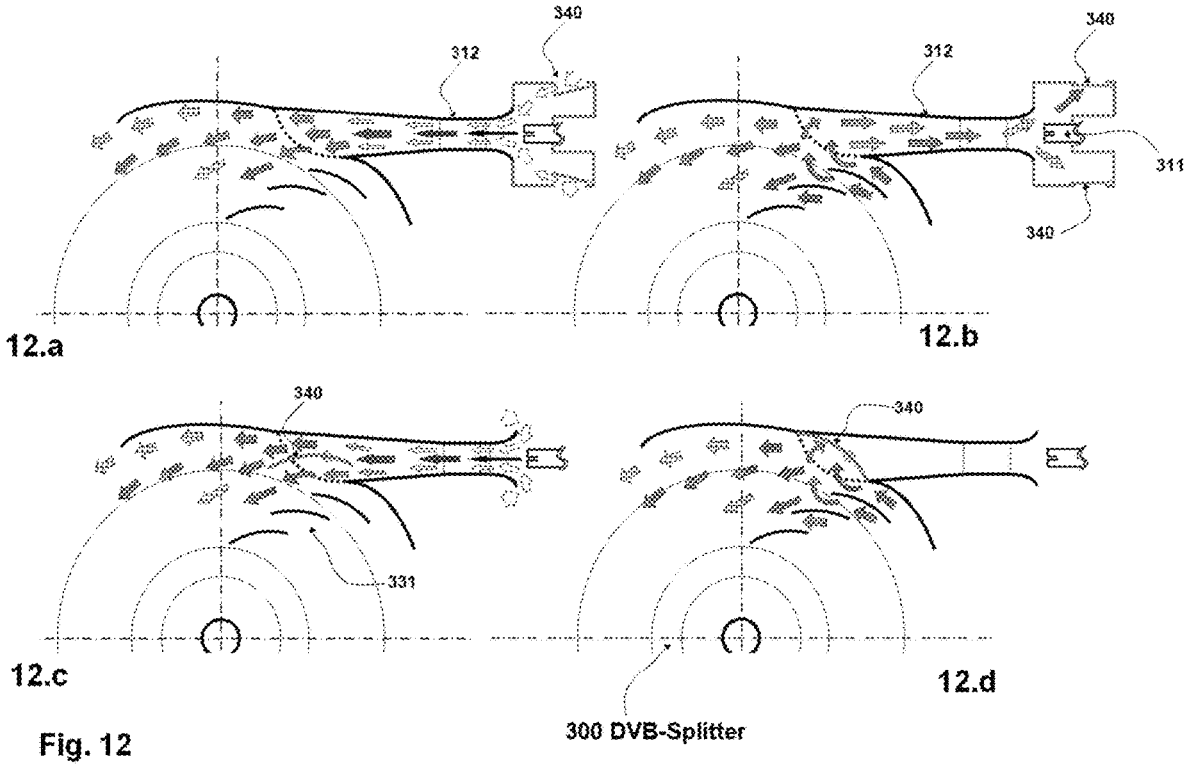
Figure 13:
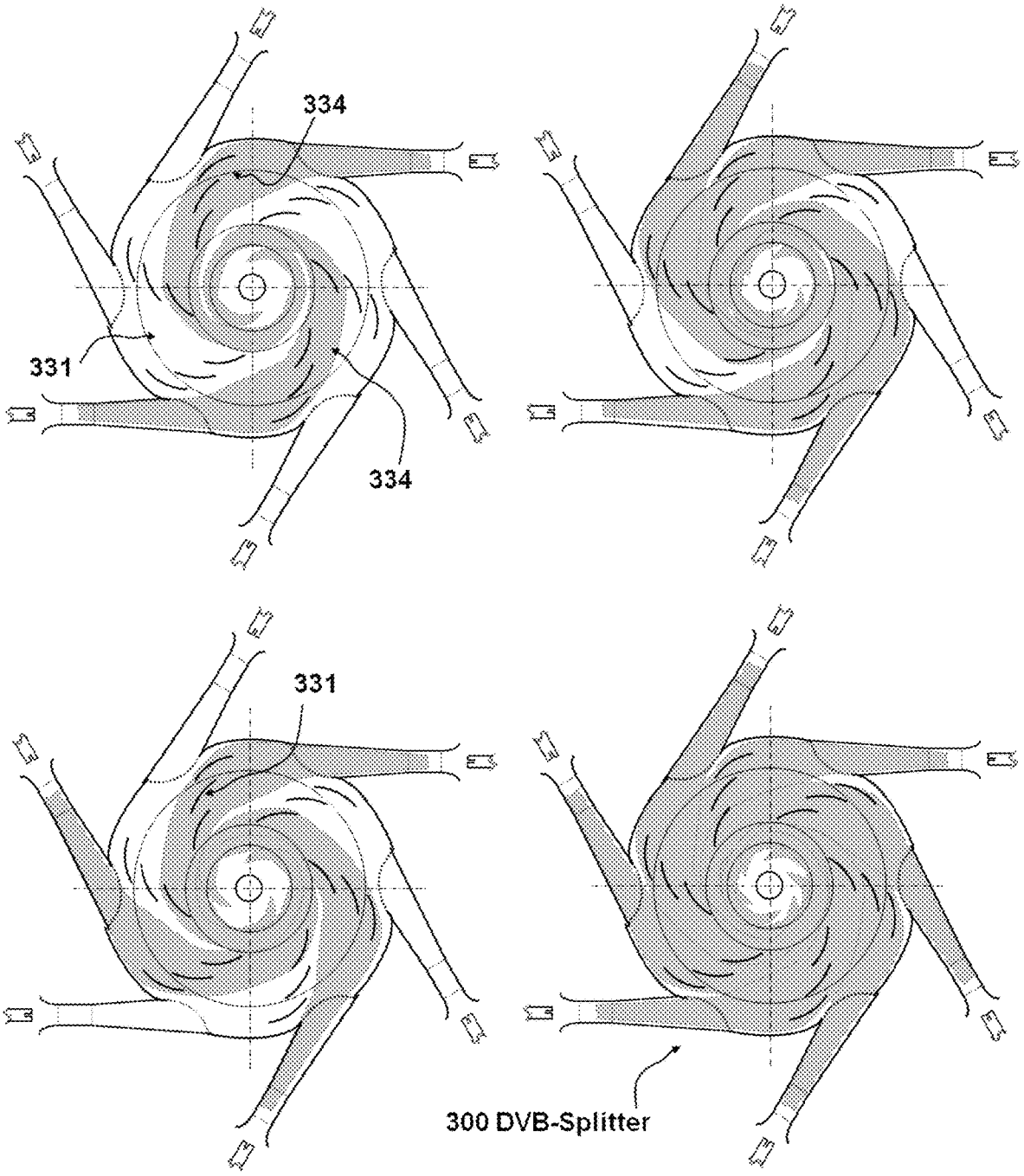
Figure 14:
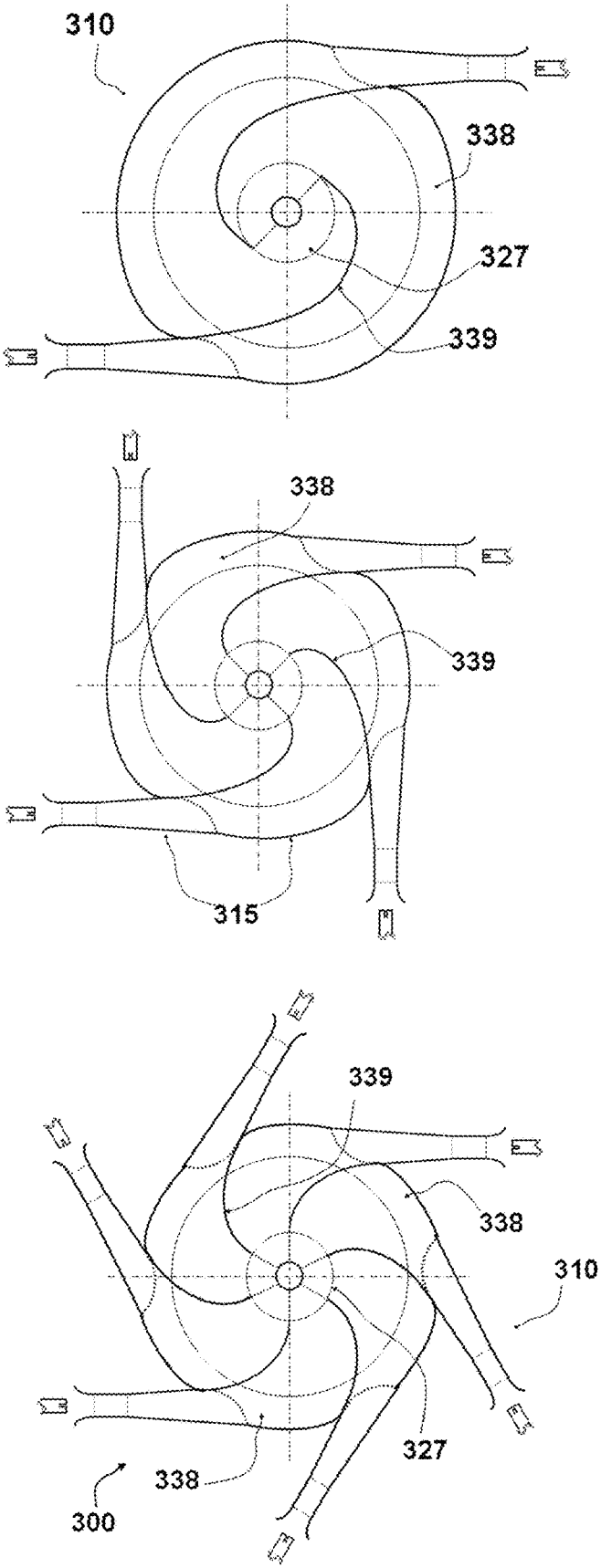
Figure 15:
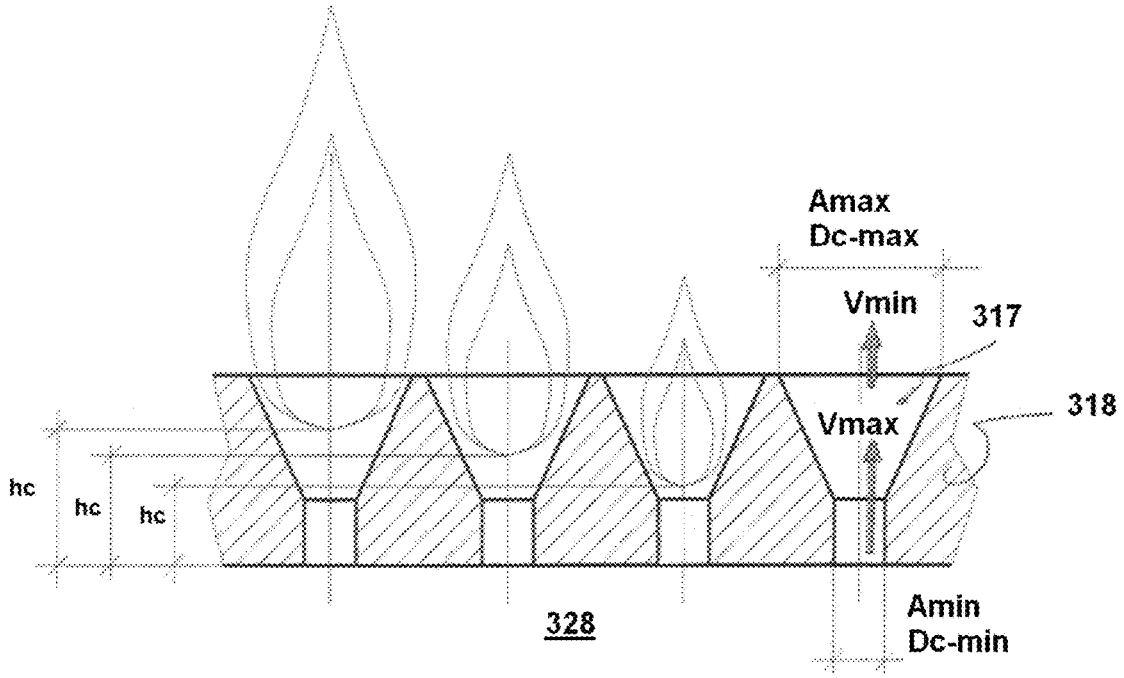

FIG. 12, in details a, b, c, d, c, shows two possible variants of the burner according to the invention;

FIG. 13 shows methods for choking the power in the burner according to the invention; in particular according to the variants of the burner of FIG. 11;

FIG. 14 shows a second basic version of the invention;

FIG. 15 shows details of a flame spreading cap for burners according to the invention.

Figure 16:
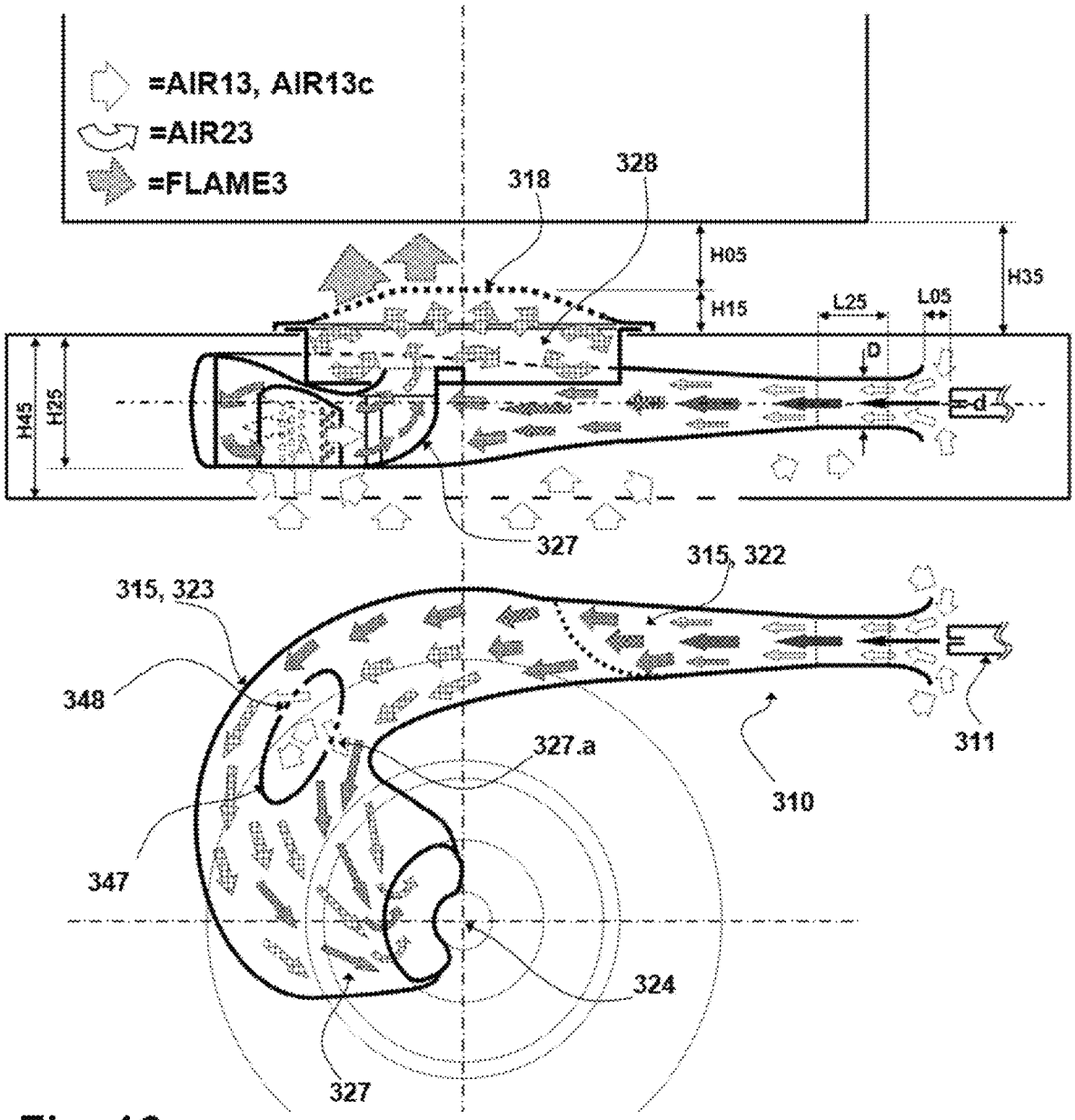

FIG. 16 shows a third version of the invention.

Unless otherwise specified, any possible spatial reference in this report such as the terms vertical/horizontal or lower/upper refers to the position in which the elements are located in operating conditions while spatial terms such as previous/subsequent, upstream/downstream should be understood with reference to the direction of circulation of the flows of airforms.

Figure 1:
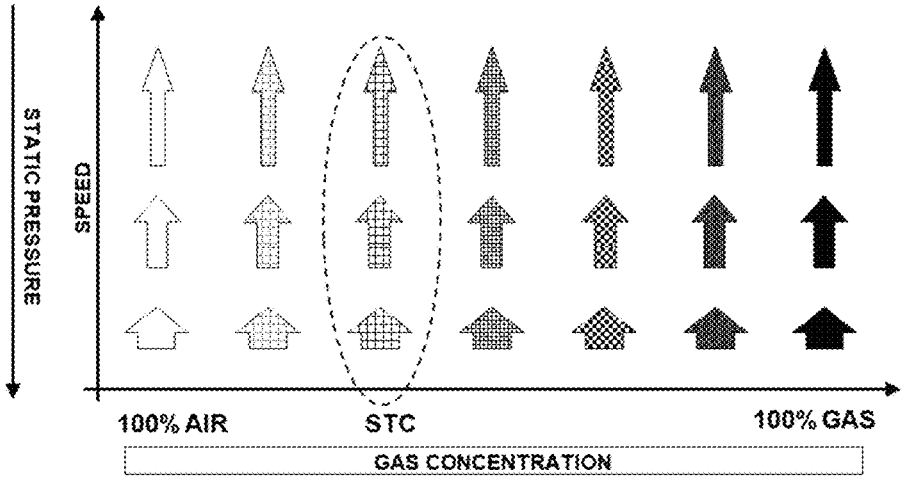
FIG. 1 shows, in a graphical legend, arrows symbolizing air-gas mixtures of different titre and inflow rate that are used by way of example, without any intent to provide quantitative data, in other figures.

In FIG. 1 arrows are drawn, each of which symbolizes a flow of mixture of a different speed and titre. These arrows are used in many of the subsequent figures to exemplify without, as already mentioned, any intent to provide quantitative indications, the substantial state of the air, gas and mixture thereof at various points upstream, downstream and inside the illustrated burners.

Figure 2:
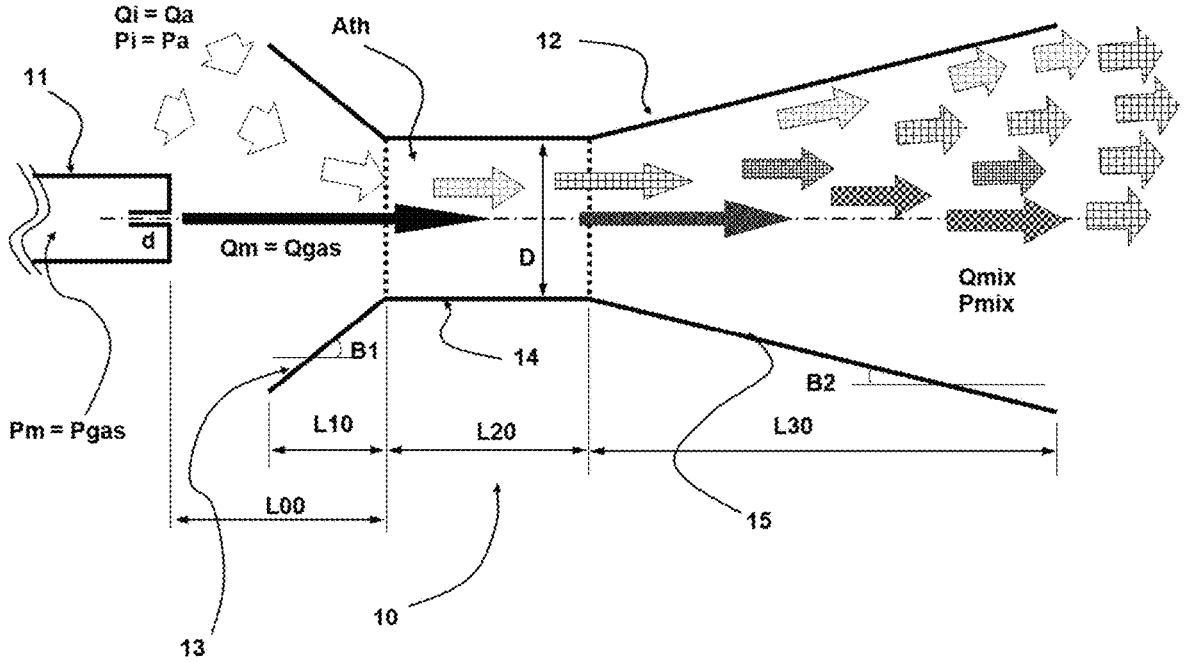
FIG. 2 shows, in a section view and schematically, a Venturi ejector.

FIG. 2 shows, out of scale, a Venturi ejector 10 with straight axis, which is the ideal shape to maximize its efficiency $\eta_{ej}$.

The following are indicated of the ejector 10: the Venturi 12, the converging section (or, simply, the "convergent") 13 of opening semiangle B1 and length L10; the groove 14 of diameter D and length L20; the diverging section 15 (also referred to as simply "divergent 15" or "diffuser 15") of opening semiangle $B_2$ and length L30, the nozzle 11 at a distance L00 from the inlet of the groove 14. The nozzle 11 has section $A_n$; the groove 14 has section $A_{th}$.

Figure 3:
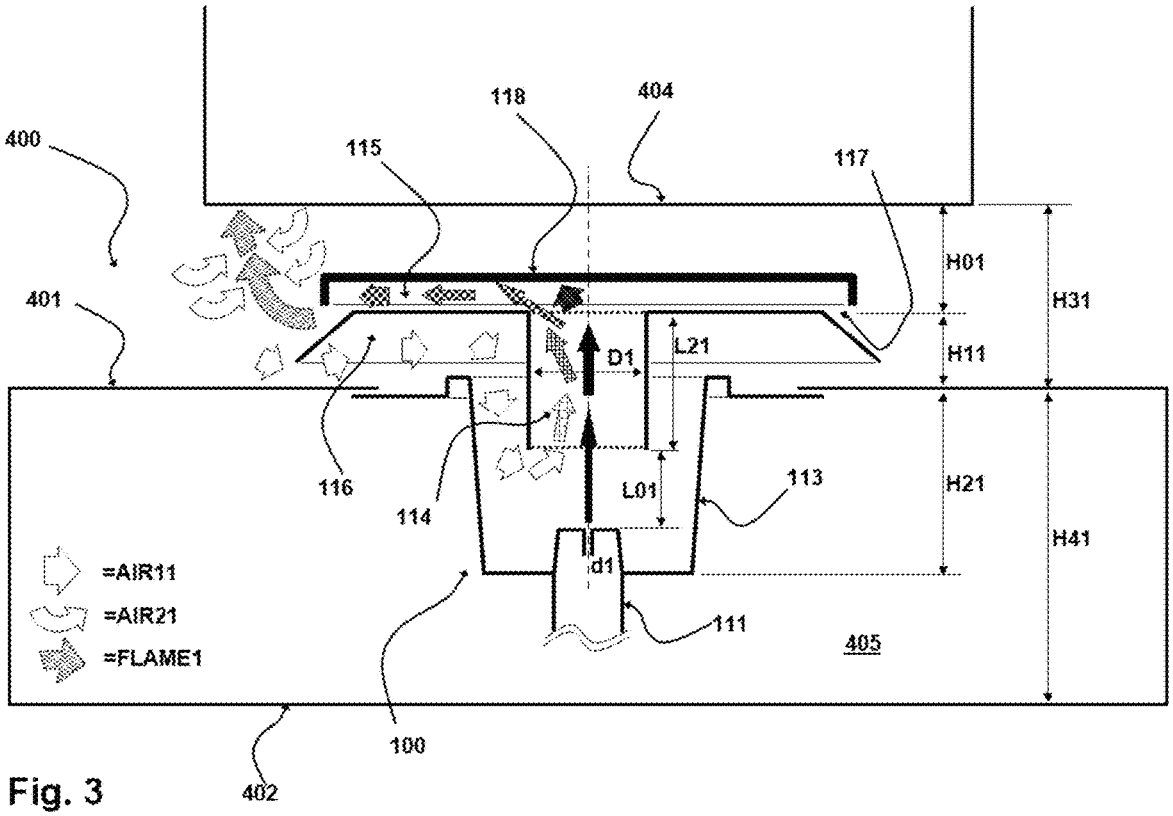
FIG. 3 shows, in vertical section, a burner of STD type.
Figure 4:
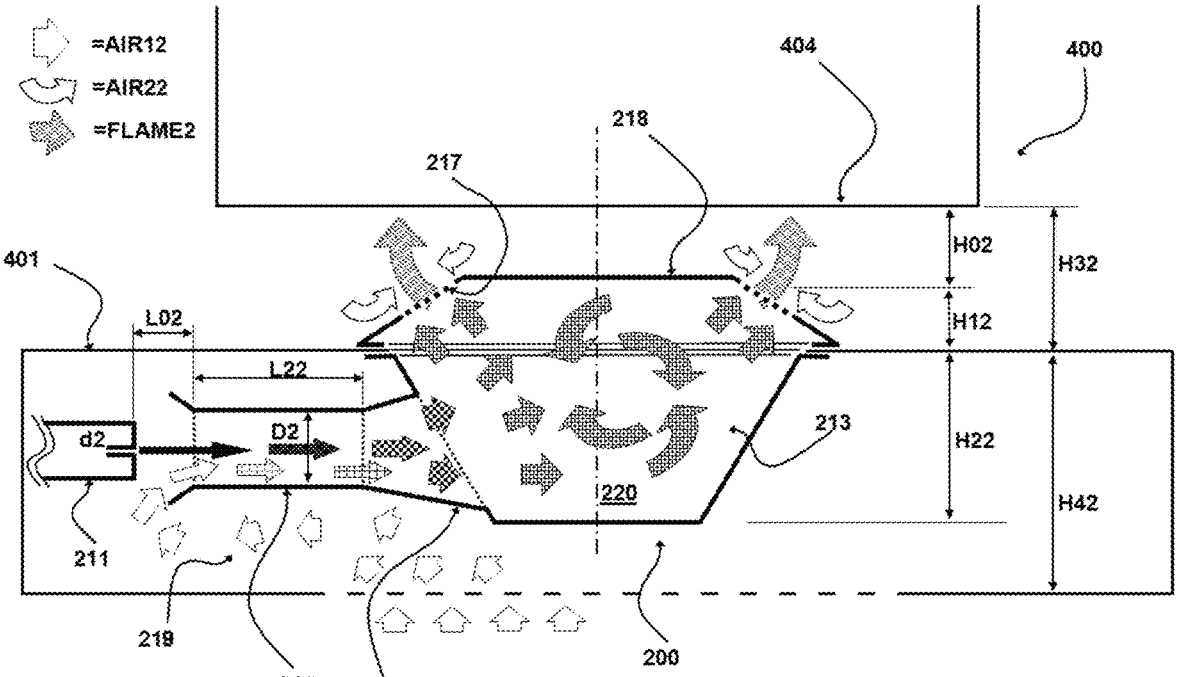
FIG. 4 shows, in vertical section, a burner of LIN type.

FIGS. 3 and 4 do not need special comments showing respectively a burner of STD and LIN type according to the state of the art and having already been recalled. Suffice it to say that, in both: 400 indicates the cooking top as a whole; 401 its covering top; 402 its bottom, that is to say the surface which confines it at the bottom; 404 the bottom of a pot resting on a grid above the burners; a grid that, for greater clarity of the illustrations, is never drawn either in this or in the subsequent figures.

Theoretical investigations, confirmed by experimental tests carried out by the applicant have shown, within the technical scope of atmospheric gas burners for cooking tops, that, as the diameter d of the nozzle 11 (see FIG. 2) varies the best efficiencies $\eta_{ej}$ of the ejector 10 relate to dimensions significantly smaller than the sizes typically used. In particular it is possible to obtain STC or leaner mixtures by applying the following sizes to an ejector 10 shaped as in FIG. 2:

- diameter d of the nozzle 11 comprised between 0.08 and 0.85 mm to which corresponds a power $W_{ei}$ preferably comprised between 40 and 1200 Watts depending on the type of fuel;
- $1/750<R<1/500$; where $R=A_n/A_{th}=(d/D)^2$ is the ratio between the groove 14 and nozzle 11 sections;
- $1<L00/D<1.5$; for shorter distances the injector becomes an obstacle;
- $2<L20/D<4$; namely, very elongated groove 14;
- $2°<B_2<4°$; namely, weak divergence of the diffuser to avoid fluid stall;
- $6<(L30/D)<12$; namely, divergent (or "diffuser") 15 significantly extended to recover pressure energy.

As to the measures L10 (length of the convergent 13) and B1 (opening semiangle of the convergent 13), they are of little influence but it is better to provide a convergent 13 of elliptical profile, jointed at the inlet of the groove 14. The axis of the ejector 10, then, should be substantially rectilinear, a characteristic, the latter, which can be met almost completely in the invention and until the end of a first stretch of the diffuser 15 where by first stretch of the diffuser 15 it is meant that part of the diffuser 15 consecutive to the groove 14 and by second stretch it is meant the remaining part of the same diffuser 15 that, of course, ends where the section of the conduit that forms it ceases to increase.

As for the sections orthogonal to the axis of the ejector 10, in particular the sections orthogonal to the axis of the diffuser 15, they may also be of elliptical section or, in general, not axisymmetric. Accordingly, the opening semiangle $B_2$ varies according to the main plane containing the axis of the same diffuser 15 whereon it is measured and then by opening semiangle $B_2$ it is meant the maximum value that can be found along and about the axis of the diffuser 15.

An ejector 10 having the geometrical features just listed and herein referred to as optimal ejector 10.

By applying such criteria, a satisfactory value of ejector efficiency $\eta_{ej}$, i.e. sufficient to form air-gas mixtures with titre ≥STC is obtained.

But the total length of a Venturi ejector 10 sized with the aforementioned criteria and sufficient to generate 1000 W, whatever the type of gas, can arrive at about 240 mm, a measure almost incompatible with the spaces available horizontally for each gas cooker of a cooking top; however, an ejector so dimensioned is not able, alone to meet the maximum power required in most of the gas cookers. Ensuring then 3 kW would result in a linear footprint of over 600 mm, a measure totally incompatible with the space available. This is actually the obstacle that the LIN burners face that therefore can not ensure efficiencies $\eta_{ej}$ of the ejector equal to those achievable in principle.

According to the invention, then, burners 300 of any power $W_b$ provided for cooking tops 400 have a quantity $Z\geq1$ of ejectors 310 that can all make their flows of mixture flow towards a single flame spreading cap 318 where:

- each burner 300 provides for a quantity $Z\geq1$ of ejectors 310 sufficient to supply, globally, the maximum power $W_b$ provided for the same burner 300 ($Z\geq W_b/W_{ei}$)
- each ejector 310, with nozzle 311 of diameter $d_3$ and groove 314 of diameter $D_3$,
  - develops on a horizontal plane,
  - has the axis of its diffuser 315 which in the first stretch 322 is substantially rectilinear and tangential to a circle with centre on the central axis 324 of the burner 300 while in the second stretch 323 gradually bends substantially as a spiral towards the same central axis 324,
  - leads, downstream of the diffuser 315, to a converging channel 327 which gradually bends vertically upwards and which, in turn, leads to one diffusion chamber 328 to which one flame spreading cap 318 acts as a cover,
  - preferably, when the quantity Z of ejectors 310 is greater than one, the said flame spreading cap 318 may be common to more ejectors 310, and, even more preferably, unique for all the ejectors 310 provided, and may provide a continuous distribution of slots 317 uniformly distributed.
  - preferably, each ejector 310 has the geometrical features specified for the optimal ejector 10 above.

It shall be specified that, at least with the features of the ejectors 310 just said, it is always possible, whatever the type of gas and supply pressure among those provided for a cooking top, to obtain from each ejector 310 a power $W_{ej}$ sufficient to make a burner of maximum power $W_b$ not lower than those normally in use for cooking tops currently making use of a reasonably limited number Z of ejectors 310 (e.g. Z<=6).

Such geometry, offers many advantages compared to the prior art; e.g.:

- each ejector 310, the power being equal, is less cumbersome than an ejector 219 of a LIN burner 200 or an optimal rectilinear ejector 10 thanks to the curvature of the second stretch 323 of the diffuser 15, the curvature, moreover, that may be as gentle so as not to penalize substantially, as it has been proven, the efficiency of ejector $\eta_{ej}$ compared to the ideal case of perfectly rectilinear diffuser; examples of acceptable but not mandatory curvatures are provided in the annexed drawings;
- the fact of possibly providing more than one ejector 310 on which allocating the total power $W_b$ provided allows to choose each ejector 310 of power $W_{ej}$ and sizes that approach or reach the values that above have proven to ensure an efficiency $\eta_{ej}$ sufficient to form air-gas mixtures with titre ≥STC;
- even if it would not be possible or wished to provide ejectors 310 adapted to form such a mixture with titre ≥STC, the geometry shown allows, downstream of the diffuser 15, to create the zones, which shall be described later, in which gradual section narrowing, sufficient to produce a lowering of the pressure of the mixture under ambient pressure may be created; in such zones of depression it is possible to create a connection with the external environment wherefrom air, herein referred to as complementary can flow in, which leans the mixture so that its titre becomes certainly ≥STC.

In short, with ejectors 310 of geometry as described above, the flame spreading cap 318, may receive mixture with titre ≥STC because each ejector 310 is sized for a maximum power $W_{ej}$ which is ≤ than the maximum power that can be obtained by keeping $\eta_{ej}$ to values suitable for producing mixtures with titre ≥STC and/or because along the route of the mixture, the entry of said complementary air is made possible to an extent at least sufficient to reach such a titre ≥STC.

Preferably each of said plurality Z of ejectors 310 is sized for said $W_{ej}$ comprised between 40 and 1200 Watts with, even more preferably, the corresponding dimensional relationships above.

As to the possible confluence of two or more ejectors 310 towards a single flame spreading cap 318, and, in particular, to the fact that it may provide for a continuous and uniform arrangement of slots 317 substantially uniformly arranged, this is an advantage of the invention made possible by the fact that, when its teachings are applied to produce mixtures with titre ≥STC, it is not necessary to provide more crowns of flames and relative adjacent spaces for the inflow of secondary air.

Preferably said plurality of ejectors 310 (see FIGS. 7 and 14) leads to sectors 338 each of which is a manifold 338 wherein the diffusers 315 of one or more ejectors 310 engage, these sectors 338 constituting also, at least for a first part thereof, the continuation and the said second stretch 323 of the same diffusers 315.

With ref. to FIG. 7, it is preferred that on the horizontal plane (on which the Venturi axes 312 lie entirely), the outer wall 319 of the diffuser 315 of the ejector 310 that precedes, is jointed to the inner wall 321 of the ejector that follows, making a succession of diffusers 315 the axes whereof may be advantageously rectilinear at least until the zone in which the diffusers 315 engage with the circumferential wall 319 and the diffuser 315 that precedes them. More generally, it is preferred that each diffuser 315 has a first stretch 322 rectilinear and of circular section and a second and last consecutive stretch 323 slightly curved that merges gradually to coincide with a corresponding peripheral portion 323 of the conveying chamber 313.

The first rectilinear stretch 322 of the diffuser 315 of each ejector 310 guides the mixture flow according to a substantially horizontal direction until it reaches the conveying chamber 313 in which said flow enters tangentially lapping the circumferential wall 319 thereof.

The consecutive curvilinear stretch 323 of said diffuser 315 is capable of inducing in the mixture flow a spiral-wise pattern towards the central axis 324 of said conveying chamber 319.

According to a first basic version that is now described (see. FIG. 7), said sectors 338 are joined into a single conveying chamber 313 that develops about the central axis 324, substantially circular or in any case of suitable shape to cause the horizontal vortex of the mixture later described; in the conveying chamber 313 said plurality of ejectors 310 comes out with a preferably axial-symmetrical arrangement.

According to such variant, preferably the quantity Z of ejectors 310 is an even number; in that case, always preferably, at least the pairs of ejectors 310 which are axially symmetrical are sized for the same maximum power $W_{ej}$.

With reference to FIG. 6, on the vertical plane passing by the axis 324 of the axial-symmetry 324, the height of the conveying chamber 313 decreases continuously from the periphery, where its peripheral portions 323 acted as second stretch 323 of the diffuser 315, towards the central axis 324 of the burner 300. The upper 325 and lower 326 walls of the conveying chamber 313 are shaped so as to approach to each other along their development in radial direction from the outside towards the inside so as to form an annular converging channel 327 as it gets close to the central axis 324; moreover, the said upper 325 and lower 326 walls, approaching the central axis 324 deviate vertically upwards transforming the annular channel 327 from centripetal to axial; once such direction is taken, the annular channel 327 leads to a diffusion chamber 328 of greater diameter than that of the annular channel 327 and delimited at the top by the "flame spreading cap 318" of the burner 300. This brings an array of holes 317 (or slots 317) for the outflow of the mixture. Thus shaped, the body of the burner 300 is such that the following flows and vortices of the mixture are formed.

On the horizontal plane, in the circumferential direction, the flow of each Venturi 312 continues to expand also in the curvilinear stretch 323 converting part of the kinetic energy into pressure, until it mixes with the subsequent flow of the Venturi 312. A horizontal vortex is created which converts the quantity of linear motion of each ejector 310 into angular momentum of the stationary vortex, extending artificially the diverging stretch of the diffusers. In this way stoichiometric mixtures are obtained that from the periphery of the conveying chamber 313 converge towards the centre in the annular channel 327 with a tangential component of speed that increases as they approach the central axis 324. The same vortex maintains a pressure gradient in the radial direction such as to create a suitable depression at the centre of the conveying chamber 313. On the vertical plane, the converging-centripetal section of the annular channel 327 further accelerates the flow enhancing the radial gradient of pressure (and the corresponding depression at the centre of the horizontal vortex). In the proximity of the central axis 324 the centripetal-axial annular channel 327 creates a vertical stream which overlaps the horizontal vortex, this way, the mixture which leads to the diffusion chamber 328 expands in it with a centrifugal motion. This results in a second stationary vortex that has a toroidal shape. The diffusion chamber 328 has a suitable shape to allow said expansion and formation of a toroidal vortex; in particular sufficient volume for expansion, diameter greater than that of the annular channel 327 and height less than the diameter.

So, according to the version of the invention just described, the burner 300 is characterised by a geometry adapted to the formation of two stationary vortices: one substantially on the lying plane of the Venturis 312 and one subsequent, toroidal.

For this reason the burner 300 according to such first variant shall be also referred to as DVB (Double Vortex Burner) burner 300.

The annular channel 327 consists of a narrow section zone equivalent to a Venturi groove, wherein the mixture increases in speed and decreases in pressure; the diffusion chamber 328 equals the diffuser of a Venturi where the mixture slows down in speed and recovers pressure. In fact, downstream of the conveying chamber 313 a sort of circumferential Venturi is created which corresponds to the rules of the Bernoulli's theorem as a classic linear Venturi.

Any burner 300 according to the invention, has ejectors 310 capable of drawing primary air AIR13 in an amount sufficient to cause the mixture with STC titre to reach the flame spreading cap 318 and therefore without the need to leave between the bottom 404 of the pot and the top of the same flame spreading cap 318 the space required for the inflow of secondary air.

However, according to one useful variant of the DVB burner 300, the diffusion chamber 328, may be advantageously put into communication with the outside environment through an axial channel 329 inside the converging annular channel 327.

In this way, induced by the depression in the annular channel 327 and by the toroidal vortex, air herein referred to as "complementary" AIR13*c* may be recalled within the diffusion chamber 328, if the titre of the mixture coming from the annular channel 327 had titre <STC. In other words, according to such variant of the DVB burner 300, it is possible to size the ejectors 310 with efficiencies $\eta_{ej}$ insufficient to obtain the STC titre, for example due to space reasons, whilst, however, without the need for the supply of secondary air AIR23 above the flame spreading cap 318.

In conclusion, the primary air AIR13 and GAS coming from the tangential ejectors 310 continue to interact up to a perfect mixing already inside the conveying chamber 313 where the titre of the mixture can be STC and over, meaning that it is also possible to obtain mixtures with excess of air. The mixture (STC or lean) that spreads inside the diffusion chamber 328, however, may be further leaned (enriched with air AIR13*c*) depending on the structure of the axial channel 329.

In short, by comparing STD, LIN and DVB burners 300 we have:

AIR11<AIR12<AIR13;AIR21>AIR22>AIR23=0

The fact that secondary air AIR23 is not required allows to reduce the space H03 between flame spreading cap 318 and bottom of the pot 404 to the minimum necessary to allow the outflow of the mixture from the same flame spreading cap 318 and the inflow of the flue gases.

An advantageous aspect of the axial channel 329 (see. FIGS. 8 and 9) is that the amount of complementary air AIR13*c* drawn through it can be easily modulated through a simple globe valve 330 optionally supported by a grid, 345.

Even more advantageously such valve 330 may be one-way and with adjustable preload.

In fact, if the valve 330 is one-way, it constitutes a safety element in case of:

- complete unbalance (excessive eccentricity) of the horizontal vortex, that may occur with some possible adjustment solutions that will be seen later;
- malfunction of one or more ejectors;
- accidental occlusion of the flame spreading cap 318 (symbolized in FIG. 8.*b* by layer 341).

Thanks to the intervention of the one-way valve 330 the dispersion of flammable mixture inside the cooking top is prevented.

The proposed DVB architecture offers countless technical, logistic and aesthetic advantages compared to the solutions available on the market.

The power $W_b$ between a LIN burner and a DVB burner 300 with Z ejectors 310 being equal, the gas passage section of the single nozzle 211 of the LIN burner, of diameter $d_2$, is equal to the sum of gas passage sections of the Z nozzles 311 of the DVB burner 300, of diameter $d_3$, thus $d_3^2=d_2^2/Z$.

Imagining that the single ejector 219 of a LIN burner has its linear dimensions $L_{i_LIN}$ proportional to the homologous $L_{i_DVB}$ of each ejector 310, we have substantially $L_{i_DVB}^2 \cong L_{i_LIN}^2/Z$ with clear space reduction of the burners on the cooking top.

The further less obvious advantages of the DVB architecture, compared to STD and LIN burners of equal power $W_b$ are at least the following:

- lower values of the minimum distance H03 between the base of the flames FLAME3 and the bottom 404 of the pot thus favouring the achievement of high values of $\eta_b$
- lower values of the minimum distance H13 between the base of the flames FLAME3 and the covering top 401 of the cooking top 400 thus making it possible to reduce H33=H03+H13 as desired i.e. the minimum distance between the bottom 404 of the pot and the covering top 401 minimizing the aesthetic impact of the "grids" and favouring innovative aesthetic proposals of the cooking top 400.
- lower values in the minimum vertical space H23 of the conveying chamber if compared to the size of the cup 113 of the STD burner or the mixing chamber 219 of the LIN burner.
- lower values of the minimum height H42, that is the minimum height of the inner compartment of the built-in cooking top, where at the height H23 the technical overall dimensions of the fuel gas supply pipe must not be added to the nozzle: it is sufficient that suitable holes are made for the access of AIR13 and AIR13*c* at the nozzles 311 and at the axial channel 329 while the conveying chamber 313 may be in fact directly in contact with the bottom 402 of the cooking top 400 further reducing H43.

The DVB architecture compared to STD and LIN extends the contact time between gas and the primary and complementary air AIR13+AIR13*c* obtaining the maximum "goodness of mixing" desired for a fully "PREMIX" combustion.

In short:

$$L23/D_3 \geq L22/D_2 >> L21/D1$$

L33/$D_3$>L32/$D_2$; it makes no sense to define a height L31 for the STD architecture

H03<H02<H01

H13<H12<H11

H33<H32<H31

H23<H22<H21

Also for the DVB burner 300 the slots 317 actually consist of arrays of holes 317 sized around a millimeter or even incisions with appropriate depth and inclination formed on the cap 318. Compared to the LIN, however, it is possible to achieve even greater power density, by further limiting the radial extension of the "bed of flames" FLAME3. It should be noted how the flames FLAME3 can be oriented in any manner (also vertical or vertical/centripetal) and arranged in any manner without having to recall AIR23.

This characteristic is of fundamental importance as it allows to:

- significantly increase $\eta_b$ in the case of small pots (typical example: the coffee makers often have a smaller bottom than the crowns of flames FLAME1/FLAME2)
- increase the contact time of the incandescent fumes with the bottom of the pot (the pot being equal)
- minimize the dilution and cooling effect by the outside air: the floatation still recalls a centripetal-vertical flow of air AIR23 that however do not take part in the combustion but rather decreases the temperatures of the periphery of the bed FLAME3; reducing the perimeter of FLAME3 this undesirable effect is reduced.

The flames FLAME3 due to combustion of the mixture with a least a completely uniform STC titre, along with the ability to handle even an excess of air, eliminate beforehand any risk of excessive production of [CO] (hence the ratio [CO]/[$CO_2$] remains systematically below the minimum limits imposed by the regulation).

The average horizontal size $D_p$ of the conveying chamber of the DVB burner 300 shown so far can not be reduced beyond a certain measure (typically Dp>10×$D_3$) or there would be a sudden drop of the efficiency $\rho_{ej}$. In fact, most of load (and efficiency) losses are located inside the horizontal vortex in the overlapping zone between the flows of two consecutive ejectors 310, where the ejector 310 that precedes interferes with the expansion of the ejector 310 that follows strongly limiting the effect of conversion of kinetic energy into static pressure.

To overcome this limitation, or to further increase the efficiency $\eta_{ej}$ the vertical space $D_p$ being equal, deflectors 331 may be suitably inserted (see. FIGS. 11, 12 and 13) consisting in an accelerating blade array 331 where each pair of adjacent blades 332 describes a converging conduit 333, having said pair of blades 332 as vertical walls and the upper 325 and lower 326 walls of the conveying chamber 313 as lower and upper walls.

Basically, the blade array 331 starts at the engagement start point 335 of each diffuser 315 on the circumferential wall 319 of the conveying chamber 313 and continues towards the central axis 324 with a substantially spiral pattern. More exactly, and in more general terms, the blade array 331 is arranged along the zone 334 where the flows of two consecutive ejectors 310 come into contact. This blade array 331 has the task of guiding the air flow exiting from the preceding ejector 310 deviating it actively in a centripetal direction. The fluid flow of mixture is accelerated (with consequent decrease of the local static pressure) towards the centre of the horizontal vortex in a significantly greater manner than the homologous conveying chamber without deflectors 331; a greater spread of the flow exiting from the ejector 310 that follows is thus achieved. In practice, the second stretch 323 of each diffuser 315 is confined on three sides by solid outer, upper and lower walls 319, 325, 326 of the conveying chamber 313 and on the fourth side by a "fluid barrier" created by the flow accelerated by the preceding deflector 310.

These blade arrays 331, by virtue of their function of flow separators, are herein globally referred to as "Splitter" while "DVB-Splitter" the variant of DVB burner 300 provided with Splitter.

The operation of a DVB burner 300 or DVB-Splitter burner 300, or in any case of a burner 300 in which more ejectors 310 lead to sectors/manifolds 338 communicating with each other, poses the problem of the back flow of flammable mixture from the conveying chamber 313 towards the inner compartment 405 of the cooking top 400, passing through the Venturis 312 not supplied, if an adjustment is used, later referred to as "progressive", where one or more ejectors 310 are disabled when the maximum deliverable power is not required.

This drawback can be advantageously addressed through the use of suitable low load loss non-return valves 340 or 342.

Such non-return valves 340 or 342 may be one-way valves 340 arranged, for example (see FIG. 12) either at the inlet of the Venturis 312 or internally, for example at the end of its first stretch 322. The details from 12.*a* to 12.*c* show the two examples of one-way valves 340 in the open (left) and closed (right) position.

Alternatively, such non-return valves 340 or 342 may be solenoid shut off valves 342 operated by the control knob of the burner 300 when this deactivates the corresponding ejector 310.

It is in fact evident that the one-way valves 340 may be easily operated by magnetic control; the version illustrated in FIGS. 12.*a* and 12.*b* in particular.

Alternatively (see FIG. 7), shut-off non-return valves 342 may be provided, the shutter whereof comprises a simple sliding collar 346 on the nozzle 311 of the ejector 310; the collar 346 is called by a magnetic force or other equivalent means to close the inlet of the Venturi 312, at the command of the gas valve whenever it shuts off the same ejector 310. For graphical simplicity, in FIG. 7 such sliding collar 346 is designed only on two nozzles 311, in open and closed position.

All variants indicated for such non-return valves 340 or 342 are provided only by way of example in order to show that they may consist in very simple devices.

In accordance to a second basic version, herein referred to as with "Separators" (see FIG. 14), alternative to the first main variant the object whereof is a DVB burner 300, the burner 300 provides a number Z of sectors 338 in each of which one and only one of the provided Z ejectors 310 engages.

Such sectors 338 as well as the corresponding consecutive conduits including corresponding Z "sectors of diffusion" 328 of the said diffusion chamber 328 are completely separated from each other up to the flame spreading cap 318.

In this way, since the interferences between two adjacent sectors 338, are completely avoided, each ejector 310 may be enabled separately without any axial-symmetry restriction (any Z, even odd) and the power modulation allows broad alternative options.

Preferably, such Z sectors 338 and subsequent conduits are obtained by providing a conveying chamber 313, an annular channel 327 and a diffusion chamber 328 shaped as described for the first main variant except that all such environments are divided into Z conduits by Z vertical partitions 339.

Preferably such vertical partitions 339 have a spiral-wise plan pattern so as to avoid as much as possible sudden changes in the direction of the flows of the mixture. Preferably such spiral-wise pattern follows the lines that the flows of mixture would take if the partitions 339 were absent.

It is still possible to provide an axial channel 329 from which complementary air AIR13*c* is drawn, divided as well by partitions in Z parts each communicating with a corresponding sector 338 that leads to the respective sector 328 of the diffusion chamber 328.

Advantageously, although not shown in the figures, the Z sectors 328 of the diffusion chamber 328 may have, in a plan view, concentric arrangement.

Advantageously, especially in such latter execution, the flame spreading cap 318 may be composed of one or more elements 318 separate from each other and each intended to cover only one or more of the Z sectors 328 in which the diffusion chamber 328 is divided into.

With such second basic version the risk of mixture "backflows" in the cooking top 400 is annulled and the non-return valves 340 or 342 are no longer required greatly simplifying the device.

On the other hand the intensity of the horizontal vortices decreases and the fluid-dynamic efficiency of the vortices in each of the isolated sectors 328 of the diffusion chamber 328 is worsened.

In short, having indicated the efficiencies $\eta_{ej}$ and $\eta_b$ of burners of the DVB_SPLITTER 300, DVB 300, 300 with partition, LIN and STD type with the suffixes SPLITTER, DVB, SETTI, LIN and STD, we can affirm that $$\eta_{ej_SPLITTER} > \eta_{ej_DVB} > \eta_{ej_SETTI} > \eta_{ej_LIN} > \eta_{ej_STD}$$

$$\eta_{b_SPLITTER} > \eta_{b_DVB} > \eta_{b_SETTI} > \eta_{b_LIN} > \eta_{b_STD}$$

The entire power range of the STD or LIN gas cookers making up a common cooking top, which is typically of 600÷800 W for the auxiliary; 1500÷2500 W for the semirapid; 2500÷3500 W for the rapid; 3500÷5000 W for the optional multiple crown, requires specific burners and corresponding equipment.

An advantageous opportunity of the invention, at least applicable to any variant described herein, provides, instead, the possibility of making burners 300 of the various powers required by resorting for most part to a few modular basic elements.

Such variant provides (see in particular FIG. 11):

- a single modular element, unchanging 336 as the the power of the gas cooker comprising the ejector 310 changes, and, preferably, what of dimensionally unchanging is associated to the same ejector 310 such as, for example, a suitable circumferential portion of the conveying chamber 313 or of the sector 338 and, always preferably, the optional blade array 331 or a partition 339.
- a series of interlayer elements 337 alternative to each other and specific to any number Z of ejectors provided and/or power $W_b$ required to the gas cooker, substantially shaped, in a plan view, as slices of various angular width to interpose to the two or more unchanging modular elements 336 provided and such that, interposed to the modular functional elements 336 and optionally with the addition of other components, are capable of making at least the conveying chamber 313 or sectors 338.
- other optional elements unchanging or not related to modules It is clear that, in order to use a single unchanging modular element 336 for all the powers $W_b$ provided, said $W_{min}$ the maximum power provided for the auxiliary burner of a generic cooking top 400 of a particular model, $W_{max}$ the maximum power provided for the rapid burner or for the existing multiple crown burners, Z the maximum number of ejectors that a DVB burner 300 can receive, the sizing of the modular functional element 336 is preferred to be made for a power $W_b$ equal to at least half of that provided for the auxiliary ($W_b$>=$W_{min}$/2) and at least 1/Z times the maximum provided ($W_b$>=$W_{max}$/Z).

Of course, the unchanging modular elements 336 may be shaped so as to be directly joined to each other without the need for interlayer elements 337 when Z takes the maximum value provided and/or constructively possible (which, generally can be 6).

This variant offers enormous advantages from the logistical and productive point of view: with very few components made for example of pressed sheet welded to each other or die-cast components that can be assembled together, it is possible to obtain all the codes of the list.

FIG. 16 shows the configuration that a burner 300 provided with a single ejector 310 that can incorporate all of the features and the basic elements of the invention already described may have; for example the mixture may be introduced into the diffusion chamber 328 in a sufficiently central position to produce the toroidal vortex of the mixture.

Although not shown in the figure, even such burner 300 with a single ejector 310 may be provided, in addition, with the suction of complementary air AIR13*c* from an axial socket 329 equivalent to the already described axial channel 329; at the outlet of the mixture into the diffusion chamber 328. However, the figure shows an alternative to such solution consisting of a narrow section zone 327.*a* substantially at the end or within the second stretch 323 of the diffuser 315 where the section narrowing is sufficient to bring the pressure of the mixture below the atmospheric pressure. Such narrow section 327.*a* is caused by a distributing body 347 which obstructs part of the channel for the flow of the mixture. Such distributing body 347 has passages 348 communicating with the outside through which complementary air AIR13*c* can reach the mixture leaning it up to a titre certainly ≥STC.

Such complementary air intake means AIR13*c* is not, according to the invention, specific of burners 300 with a single ejector 310 as in FIG. 16 but can be applied at least to all variants described above by providing a number N of distributing bodies 347 arranged in an axial-symmetrical manner about the central axis 324. Preferably the quantity N of such distributing bodies 347 is equal to the number of sectors 338; even more preferably it is equal to the number Z of ejectors 310.

As for the power modulation, a burner 300 may be regulated via a single adjusting valve that supplies all the Z injectors 310 in parallel, connected to a single manifold conduit (not shown in the figures). This type of regulation is herein referred to as "modulating parallel".

However it is also possible to connect each ejector 310 or different groups of ejectors 310 separately to a single special valve that enables them sequentially modulating the power delivered by a first group of ejectors 310 from minimum to maximum before moving on to modulate a subsequent group, and so on. This type of regulation is herein referred to as "modulating progressive".

This extreme power modulability, even if easily possible, may however be overabundant compared to the practical needs, as it is sufficient, as also in the electric cookers, a discreet adjustment with a sufficient number of steps.

The architecture of the burner 300 according to the invention, compared to the known burners, offers advantageously and easily such a completely new possibility of discrete power adjustment with a modulation ratio that can depend only on the number Z of ejectors 310 available. Choking does not take place by reducing the gas pressure to the injectors 310 in a continuous manner, but each of them may be solely supplied ON/OFF at maximum power (for which, then, may be optimized as to $\eta_{ej}$) or not supplied at all.

Considering, for example a burner 300 (DVB or DVB-Splitter) with Z=6 ejectors 310 the discrete adjustment levels available are OFF, 33% (two ejectors out of 6), 50% (three out of 6), 66% (four out of six) and 100% (six out of six) by simply enabling the ejectors in a suitable sequence.

The modulation ratio Y thus obtained is 100/33≈3 as well as already for the LIN burners. However, thanks to this unique feature of modulating the power through the ON/OFF activation of the single ejectors 310, the DVB burners 300 ensure efficiencies $\eta_b$ and optimal and constant combustion ratios [CO]/[$CO_2$] throughout the regulation of the burner; this by employing simple shut-off valves, far more simple, economical, reliable and compact than the special valves and common adjusting valves. This type of regulation is herein referred to as "discrete progressive"

It has been experimentally noted that the burners 300 of the first basic DVB or DVB-Splitter version 300 maintain acceptable functional features also disabling one or more ejectors 310, provided that the consequent operation configurations of the horizontal vortex are balanced (axial-symmetrical or substantially axial-symmetrical). In other words, the active ejectors 310 must be in an axial-symmetrical or substantially axial-symmetrical position, or there would be a considerable decay of the efficiency $\eta_{ej}$ due to the eccentricity of the consequent horizontal vortex.

On the other hand such need for a substantial axial-symmetry does not exist for "partition" burners 300 according to the second basic version, with broad freedom of modulation that may provide, then, also the activation of a single ejector 310 at a time.

It is clear that the three different regulation modes described, "modulating parallel", "modulating progressive" and "discrete progressive" may, in turn, be combined together in multiple variants or be simultaneously present in the same cooking top 400 but on different burners 300.

However, the fact that the titre of the mixture obtained in the burners 400 according to the invention may be ≥STC, would accentuate the problems of instability of the flames already described when talking about the LIN burner if flame spreading caps 318 according to the technologies known from the same LIN burners were used.

However, it is possible (see FIG. 15) to use flame spreading caps 318 in which the slots 317 have section increasing from the inside to the outside of the same flame spreading cap 318 so that the mixture, flowing through the slots 317, reduces its outflow rate from a first value $V_{max}$ at the inlet to a second value $V_{min}$ at the outlet. By suitably selecting the minimum innermost $A_{min}$ and maximum outermost $A_{max}$ sections (i.e. the minimum $D_{c_min}$ and maximum $D_{c_max}$ diameters of the slot 317 if this is conical), the flame F is then stabilized at a height $h_c$ thereof which depends on the flow rate of the mixture and the flame speed $V_f$ which, in turn, substantially depends on the titre of the mixture and the type of gas. Simplifying, we can affirm that if a mixture has titre ≥STC, and thus the combustion is independent of secondary air, the flame is stable if its flame speed $V_f$ is equal to the outflow rate of the mixture.

Therefore a slot 317 of increasing section ensures flame stability if

- its minimum section $A_{min}$ ensures an outflow rate $V_{max} \geq V_f$ for the maximum flame speed $V_f$ and the minimum mixture flow rate provided;
- its maximum section $A_{max}$ ensures an outflow rate $V_{min} \leq V_f$ for the minimum flame speed $V_f$ and the maximum mixture flow rate provided.

In fact, if the flame tends to stall due to excessive speed of the mixture or type of mixture, it moves towards an outermost part of the slot 117 where the speed of the mixture reduces; vice versa, in the event of a tendency to backfire, this moves towards the innermost part of the slot where the speed of the mixture exceeds the flame speed $V_f$.

If the chosen modulation ratio Y is very high, it may be necessary to provide slots 117 and thus flame spreading caps 318 specific for various gas families but this may be the only adaptation required by a burner 300 according to the invention.

With such diverging slots 317, the flame F is often nested within them which causes high heating of the flame spreading cap 318. Consequently, it must be of material resistant to combustion temperatures, for example steel alloy so called refractory such as AISI 321 or 309 or 910 alloys or, preferably, ceramic.

It is not necessary to dwell on such flame spreading caps with diverging slots because per se known and used, for example, in certain types of gas heaters or radiant panels.

With one or more of the devices provided for by the described variants relating to the regulation, a DVB burner 300 may, in principle, be modulated at least from the power $W_{min}$ currently provided for the auxiliary burners to the maximum power $W_{max}$ of the current multiple crown burners.

As to the adjustment of a DVB burner 300 to different types of gas, while a LIN burner, as already said, must be completely replaced, including the flame spreading cap 218, a DVB burner 300 allows the use of a single type of ejector 310 and corresponding Venturi 312 for both methane and LPG and, above all, in general, the use of the same flame spreading cap 318 having the same slots 317, thanks to the possibility to exclude/include the ejectors 310 as desired. For example, a DVB or DVB/Splitter burner 300 with a number of ejectors 310 Z=4 would use all of them when supplied with methane while, to configure the LPG supply it would suffice to permanently exclude 2 opposite ejectors 310 and, optionally, to act on the preload of the one-way valve 330 of the axial channel 329.

Once the various features on which the burner 300 with multiple ejectors 310 is based have been clarified it is clear that many variants, also exemplary, are possible without departing from the scope of the invention.

Finally, it is clear that a burner 300 according to the invention achieves all the stated objects in addition to ensuring further multiple advantages.

The invention claimed is:

1. An atmospheric gas burner for cooking tops wherein an air-gas mixture is obtained by an effect of gas supply pressure using a tube ejector of Venturi principle, comprising:

a quantity Z≥2 of ejectors configured to supply maximum power ($W_b$) to said burner, wherein each of said ejectors develops on a horizontal plane, wherein each of the ejectors includes a diffuser, wherein an axis of its diffuser which in a first stretch is substantially rectilinear and tangential to a circle with a center on a central axis of said burner while in a second stretch gradually bends substantially, still on said horizontal plane, as a spiral towards the central axis, and wherein each of the ejectors leads, downstream of said diffuser, to a converging channel which gradually bends vertically upwards and which, in turn, leads to one or more diffusion chambers to which one or more flame spreading caps act as cover, wherein each of said Z ejectors includes:

a nozzle, wherein a nozzle diameter (d) is between 0.08 and 0.85 mm inclusive;

1/750<R<1/500, where R is the ratio between sections of a Venturi groove and the nozzle diameter of said ejectors;

1<L00/D<1.5, where L00 is the distance of said nozzle from the inlet of said Venturi groove and D is a diameter of said groove;

2<(L20/D)<4, where L20 is a length of said groove;

2°<$B_2$<4°, where $B_2$ is a maximum opening semi-angle of each of said diffusers;

6<(L30/D)<12, wherein L30 is a length of said diffuser;

converging channel of said ejectors includes an elliptical profile and jointed at an inlet of said Venturi groove; and a Venturi axis of said ejectors substantially rectilinear in the first stretch after the groove.

2. The atmospheric burner according to claim 1, wherein when said ejectors are in a quantity Z≥2 they engage, according to said substantially tangential direction, on an outer circumferential wall in a plurality of sectors, thereby forming at least for a first portion thereof, the second stretch of said diffusers, circularly distributed below said one or more flame spreading caps, each of said sectors receiving one of more of said ejectors.

3. The atmospheric burner according to claim 1, wherein the one or more flame spreading caps are configured to produce the air-gas mixture that reaches said flame spreading cap to have a titre ≥stoichiometric ratio STC.

4. The atmospheric burner according to claim 1, characterised in that power ($W_{ej}$) of each of said Z ejectors is comprised between 40 and 1200 Watts according to the type of fuel.

5. The atmospheric burner according to claim 2, further comprising slots and flame spreading caps interchageable for various gas families.

6. The atmospheric burner according to claim 5, wherein said flame spreading cap is common to two or more of said Z ejectors provided.

7. The atmospheric burner according to claim 2, wherein two sectors are joined in a single conveying chamber which develops about said central axis and is configured to cause a horizontal vortex of the air-gas mixture introduced and where said plurality of ejectors includes an axial-symmetrical arrangement.

8. The atmospheric burner according to claim 7, wherein the quantity Z of said ejectors is an even number and at least the pairs of said ejectors which are axially symmetrical are sized for the same maximum power ($W_{ej}$).

9. The atmospheric burner according to claim 7, wherein flows of said mixture singularly induced by each of said ejectors flow into said single flame spreading cap, and upper and lower walls of said conveying chamber while approaching the central axis, approach toward each other forming an annular converging channel, transforming said annular channel from centripetal to axial, said annular channel leading to a diffusion chamber of larger diameter than the annular channel and configured to allow an expansion and formation of a toroidal vortex of said mixture and delimited on top by said flame spreading cap.

10. The atmospheric burner according to the claim 9, wherein said diffusion chamber is put into communication with outside environment by means of an axial channel, internal to said annular converging channel, along which external air may be drawn due to the depression procured at a center of the horizontal vortex, said annular converging channel forming said narrow section zone.

11. The atmospheric burner according to claim 10, wherein a globe valve is provided in said axial channel, suitable for modulating a quantity of said air that can be drawn through the same axial channel.

12. The atmospheric burner according to claim 11, wherein said globe valve is one-way and with adjustable preload.

13. The atmospheric burner according to claim 9, wherein deflectors are provided inside said conveying chamber, consisting of an accelerating blade array where each pair of adjacent blades of the blade array describes a converging conduit having said adjacent blades as vertical walls and the said upper and lower walls of the same conveying chamber as lower and upper walls, said blade array being arranged along the zone where the flows of two consecutive of said ejectors come in to contact.

14. The atmospheric burner according to claim 7, wherein said ejectors are provided with a low load loss non-return valve adapted to avoid backflows of said mixture towards the inner compartment of said cooking top.

15. The atmospheric burner according to claim 14, wherein said non-return valves are one-way valves located at an inlet or at an intermediate point of the Venturi of said ejectors.

16. The atmospheric burner according to claim 14, wherein aid non-return-valves are electro-mechanically actuated shut-off valves which close at the command of the gas valve whenever it shuts off the correspondent ejector and are located at the inlet or at an intermediate point of the Venturi of said ejectors.

17. The atmospheric burner according to claim 16, wherein said shut off valves are located at the inlet of said Venturi and have a shutter comprising a sliding collar on the nozzle of said ejectors.

18. The atmospheric burner according to claim 1, further comprising a narrowing section zone configured to decrease pressure of the air-gas mixture below atmospheric pressure, and complementary air can reach said air-gas mixture.

19. The atmospheric burner according to claim 18, wherein said narrow section zone is a narrow section zone located substantially at an end or within the said second stretch of said diffusers, caused by a distributing body which obstructs part of the channel for the flow of the mixture, the section narrowing being such as to take the pressure of the mixture below the atmospheric pressure, said distributing body being provided with openings adapted to provide complementary air to the mixture.

20. The atmospheric burner according to claim 1, wherein it provides a number Z of said sectors separate from each other and in each of which one and only one of said ejectors engages, said sectors leading to its own consecutive conduit also completely separate from the other conduits up to correspondent Z sectors of the said diffusion chamber.

21. The atmospheric burner according to claim 20, wherein said flame spreading cap is composed of one or more elements separate from each other and each intended to cover only one or more of said Z sectors wherein said diffusion chamber is divided into.

22. The atmospheric burner according to claim 1, wherein said one or more flame spreading caps have slots of increasing section from the inside towards the outside of the same caps from a minimum section to a maximum section thereof, wherein the said minimum section ensures an outflow rate $V_{max} \geq V_f$ for the maximum flame speed $V_f$ and the minimum flow rate of said mixture, expectable, wherein its maximum section ensures an outflow rate $V_{min} \leq V_f$ for the minimum of said flame speed $V_f$ and the maximum flow rate of said mixture, expectable.

23. The atmospheric burner according claim 1, wherein said one or more flame spreading caps are of a material resistant to combustion temperatures.

24. A method for adjusting the power of an atmospheric burner according to claim 1, wherein said ejectors are modulated simultaneously in parallel.

25. The method for adjusting the power of an atmospheric burner according to claim 24, wherein the power of a first group of said ejectors is modulated from minimum power to maximum power before proceeding to modulate a second group of said ejectors.

26. The method for adjusting the power of an atmospheric burner according to claim 24, wherein two or more of said ejectors are activated in progression, each of which is either disabled or operational at its maximum power.

* * * * *